US008524437B2

(12) United States Patent
Yamauchi et al.

(10) Patent No.: US 8,524,437 B2
(45) Date of Patent: Sep. 3, 2013

(54) PARTICLE PRODUCING METHOD, PARTICLE, TONER, DEVELOPER, PROCESS CARTRIDGE, IMAGE FORMING METHOD, IMAGE FORMING APPARATUS, AND PARTICLE PRODUCING METHOD

(75) Inventors: Yoshitaka Yamauchi, Shizuoka (JP); Chiaki Tanaka, Shizuoka (JP); Taichi Nemoto, Shizuoka (JP); Keiko Osaka, Shizuoka (JP); Shinji Ohtani, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 20 days.

(21) Appl. No.: 13/364,738

(22) Filed: Feb. 2, 2012

(65) Prior Publication Data

US 2012/0225377 A1 Sep. 6, 2012

(30) Foreign Application Priority Data

Mar. 4, 2011 (JP) ..... 2011-047420
Mar. 16, 2011 (JP) ..... 2011-058205

(51) Int. Cl.
*G03G 9/087* (2006.01)

(52) U.S. Cl.
USPC ..... 430/137.1

(58) Field of Classification Search
USPC ..... 430/137.1
See application file for complete search history.

(56) References Cited

U.S. PATENT DOCUMENTS

| | | | | |
|---|---|---|---|---|
| 7,390,607 | B2 | 6/2008 | Tanaka et al. | |
| 7,396,625 | B2 | 7/2008 | Tanaka et al. | |
| 7,709,175 | B2 | 5/2010 | Ohtani | |
| 2005/0112492 | A1 * | 5/2005 | Makino et al. | 430/105 |
| 2006/0145375 | A1 * | 7/2006 | Chattopadhyay et al. | 264/13 |
| 2006/0183045 | A1 * | 8/2006 | Nakano et al. | 430/105 |
| 2008/0286679 | A1 * | 11/2008 | Norikane et al. | 430/110.4 |

FOREIGN PATENT DOCUMENTS

| | | |
|---|---|---|
| JP | 3-149567 | 6/1991 |
| JP | 8-176310 | 7/1996 |
| JP | 9-34167 | 2/1997 |
| JP | 2004-302323 | 10/2004 |
| JP | 2005-84407 | 3/2005 |
| JP | 2006-77219 | 3/2006 |
| JP | 2006-293320 | 10/2006 |
| JP | 2007-199463 | 8/2007 |
| JP | 2008-64979 | 3/2008 |
| JP | 2009-116049 | 5/2009 |
| JP | 2010-132851 | 6/2010 |

OTHER PUBLICATIONS

U.S. Appl. No. 13/285,410, filed Oct. 31, 2011, Shinji Ohtani, et al.

* cited by examiner

*Primary Examiner* — Hoa V Le
(74) *Attorney, Agent, or Firm* — Oblon, Spivak, McClelland, Maier & Neustadt, L.L.P.

(57) ABSTRACT

A particle producing method is provided including bringing a material into contact with a compressible fluid to prepare a melt of the material, and discharging the melt from a vibrated through hole to form particles of the melt. A particle producing apparatus is also provided including a discharger to discharge the melt. The discharger includes a storage to store the melt, at least one through hole disposed on the storage, and a vibrator to vibrate the through hole. The particle producing apparatus further includes a particle forming member defining a space within which the discharged melt is formed into particles and a pressure controller controlling a pressure difference between the space and an inside of the storage so that the discharged melt is formed into a columnar melt and the columnar melt is constricted and separated into particles.

5 Claims, 8 Drawing Sheets

PARTICLE PRODUCING METHOD, PARTICLE, TONER, DEVELOPER, PROCESS CARTRIDGE, IMAGE FORMING METHOD, IMAGE FORMING APPARATUS, AND PARTICLE PRODUCING METHOD

CROSS-REFERENCE TO RELATED APPLICATIONS

This patent application is based on and claims priority pursuant to 35 U.S.C. §119 to Japanese Patent Application Nos. 2011-058205 and 2011-047420, filed on Mar. 16, 2011 and Mar. 4, 2011, respectively, in the Japanese Patent Office, the entire disclosure of each of which is hereby incorporated herein by reference.

FIELD OF THE INVENTION

The present invention relates to a particle producing method using a compressible fluid, particularly particles of a crystalline polyester resin or a release agent. The present invention also relates to a particle produced by the particle producing method, a toner including the particle, a developer including the toner, a process cartridge, an image forming method, and an image forming apparatus using the toner, and a particle producing apparatus practicing the particle producing method.

BACKGROUND OF THE INVENTION

Various particulate products are manufactured by processing thermoplastic resins based on their properties. Fine resin particles are useful because they can be uniformly allocated in a product so that the product expresses a uniform property. For example, vinyl thermoplastic resins, which are generally synthesized by addition polymerization, can be obtained in the form of a dispersion by suspension polymerization or emulsion polymerization. By contrast, polyester thermoplastic resins, which are generally synthesized by condensation polymerization, cannot be obtained in the form of a dispersion by any of known polymerization procedures, and is merely obtained in the form of a block. To obtain a dispersion of polyester resins, it is necessary to take an appropriate dispersing procedure.

Japanese Patent Application Publication No. 08-176310 describes a method of producing a dispersion of a crystalline polyester resin using a phase-separation solvent. This method can merely produce a coarse particle dispersion having a dispersion diameter of several to several tens μm. Therefore, this method is not suitable for preparing a particle dispersion having a volume average particle diameter of about 1.0 μm, which can be used for toner manufacture. Generally, a dispersion of a crystalline polyester resin has strong thixotropic property. Thus, a smaller dispersion diameter makes the dispersion more viscous, which requires a longer dispersing time. Such a viscous dispersion is difficult to handle.

Japanese Patent Application Publication No. 2005-084407 describes a method of producing a resin dispersion. In this method, a crystalline polyester resin and a release agent are dissolved in an organic solvent by heating, the resulting solution is cooled so that the crystalline polyester resin and the release agent are coarsely deposited, and the coarsely deposited particles are further pulverized into small particles having a dispersion diameter of about 1 μm or less.

However, this method undesirably spends a lot of time and heat energy in the processes of heating and cooling.

Adding a release agent, such as a wax, to toner is a widely-employed technique to give releasability to the toner. Japanese Patent Application Publication No. 03-149567 describes a method of producing toner in which raw materials including a release agent and a thermoplastic resin are melt-kneaded, and the melt-kneaded raw materials are cooled and pulverized into particles. In this method, it is difficult to control particle diameter of the resulting particles. When undesired fine particles are not completely removed, basic properties of the resulting toner, such as chargeability, fixability, and heat-resistant storage stability, may be poor.

Japanese Patent Application Publication No. 09-34167 describes a method of producing toner in which raw materials including a release agent and a thermoplastic resin are kneaded, the kneaded mixture is pulverized into particles, the particles are dispersed in an aqueous medium containing hydrophilic inorganic particles, and the resulting dispersion is heated to remove the solvent and obtain toner particles. This method can control the resulting toner shape.

In this method, it is difficult to control dispersion diameter of the release agent dispersed in the thermoplastic resin. When coarse particles of the release agent are undesirably immixed in the resulting toner, basic properties of the toner, such as chargeability and fixability, may be poor.

SUMMARY OF THE INVENTION

Exemplary aspects of the present invention are put forward in view of the above-described circumstances, and provide a novel particle producing method that effectively provides fine particles of a material without consuming a lot of time and energy.

In one exemplary embodiment, a particle producing method includes bringing a material into contact with a compressible fluid to prepare a melt of the material; and discharging the melt from a vibrated through hole to form particles of the melt.

In another exemplary embodiment, a particle producing apparatus includes a discharger to discharge a melt of a material. The melt is prepared by bringing the material into contact with a compressible fluid. The discharger includes a storage to store the melt, at least one through hole disposed on a wall of the storage, and a vibrator to vibrate the through hole. The vibrator is in contact with the storage. The particle producing apparatus further includes a particle forming member defining a space within which the discharged melt is formed into particles and a pressure controller controlling a pressure difference between the space and an inside of the storage so that the discharged melt is formed into a columnar melt and the columnar melt is constricted and separated into particles.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
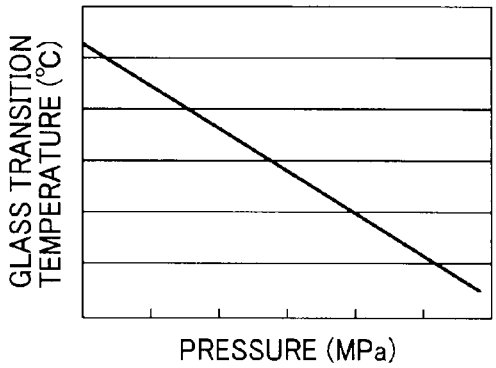
FIG. 1 is a graph showing a relation between the glass transition temperature of a pressure-plastic material (vertical axis) and the pressure of carbon dioxide as a compressible fluid (lateral axis)

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Details of crystalline polyester resins for use in exemplary embodiments are described below. Whether a polyester resin has crystallinity or not is determined by differential scanning calorimetry (DSC). Specifically, a polyester resin having crystallinity has a melting point that can be measured by DSC. The melting point can be measured by an instrument DSC Q2000 (from TA Instruments) as follows. A simple sealed aluminum pan filled with 5 to 10 mg of an analyte (e.g., a crystalline polyester resin) is firstly heated from 30° C. to 220° C. at a heating rate of 5° C./min and kept at 220° C. for 1 minute; quenched to −20° C. without temperature control and kept at −20° C. for 1 minute; and secondly heated from −20° C. to 180° C. at a heating rate of 5° C./min. The maximum endothermic peak existing within a temperature range of −20° C. to 180° C. in the DSC curve obtained in the second heating is regarded as the melting point of the analyte.

The crystalline polyester resin is obtained from a combination of an alcohol or a derivative thereof and an acid or a derivative thereof. Specific examples of suitable alcohols include, but are not limited to, diol compounds having 2 to 6 carbon atoms, preferably, those including 1,4-butanediol, 1,6-hexanediol, and/or derivatives thereof in an amount of 80% by mol or more, more preferably 85 to 100% by mol. Specific examples of suitable acids include, but are not limited to, fumaric acid and carboxylic acids having C=C double bonds. Preferably, the crystalline polyester resin has the following formula:

$$[—O—CO—(CR_1{=}CR_2)_l—CO—O—(CH_2)_n—]_m$$

wherein n and m independently represent a repeating number, l represents an integer of 1 to 3, and $R_1$ and $R_2$ independently represents a hydrogen atom or a hydrocarbon group.

It is easy to control crystallinity and softening point when the crystalline polyester resin is a non-linear polyester obtained from polycondensation between a polyol having 3 or more valences and a polycarboxylic acid having 3 or more valences. Specific examples of the polyol having 3 or more valences include, but are not limited to, glycerin. Specific examples of the polycarboxylic acid having 3 or more valences include, but are not limited to, trimellitic anhydride.

Molecular structure of the crystalline polyester resin can be determined by liquid or solid state nuclear magnetic resonance (NMR), X-ray diffraction, gas chromatography (GC/MS), liquid chromatography (LC/MS), or infrared absorption (IR). In particular, molecular structure can be easily determined from an infrared absorption spectrum. For example, a crystalline polyester resin having an absorption based on δCH (an out-of-plane vending vibration) of olefin at 965±10 $cm^{-1}$ or 990±10 $cm^{-1}$ is preferable.

The crystalline polyester resin preferably has a narrow molecular weight distribution and a low molecular weight in terms of low-temperature fixability. Specifically, a molecular weight (M) distribution chart, having a lateral axis being log(M) scale and a vertical axis being % by mass scale, of o-dichlorobenzene-soluble components in the crystalline polyester resin obtained by gel permeation chromatography (GPC) has a peak having a half bandwidth of 1.5 or less within a log(M) range between 3.5 and 4.0. Preferably, the weight average molecular weight (Mw) is 1,000 to 30,000, the number average molecular weight (Mn) is 500 to 6,000, and the ratio Mw/Mn is 2 to 8. A resin having too small a molecular weight is not suitable for toner binder. A resin having too large a molecular weight is also not suitable for toner binder because it cannot rapidly melt, resulting in poor fixability.

The melting point and F½ temperature of the crystalline polyester resin are preferably as low as possible unless heat-resistant storage stability does not deteriorate. Preferably, the melting point represented by the maximum endothermic peak existing in the DSC curve is 50 to 150° C. The F½ temperature is a half of the flow starting temperature measured by a flowtester CFT-500 (from Shimadzu Corporation). More specifically, the flow starting temperature is a temperature at which a 1-$cm^2$ sample starts melting and flowing from a die having a diameter of 1 mm while applying a pressure of 10 kg/$cm^2$ and heating at a rate of 3° C./min. A resin having a melting point and an F½ temperature of 50° C. or less has poor heat-resistant storage stability, thereby causing blocking due to heat generated in a developing device. A resin having a melting point and an F½ temperature of 150° C. or more has poor low-temperature fixability.

The crystalline polyester resin preferably has an acid value of 5 mgKOH/g or more, more preferably 10 mgKOH/g or more to improve low-temperature fixability in terms of affinity for paper. On the other hand, the crystalline polyester resin preferably has an acid value of 45 mgKOH/g or less to improve hot offset resistance. The crystalline polyester resin preferably has a hydroxyl value of 0 to 50 mgKOH/g, more preferably 5 to 50 mgKOH/g, to improve low-temperature fixability and chargeability.

Preferably, the crystalline polyester resin is a pressure-plastic material. In this specification, the pressure-plastic material is defined as a material which reduces its glass transition temperature (Tg) upon application of pressure, in other words, a material which plasticizes upon application of pressure even without application of heat. The pressure-plastic material plasticizes at a temperature lower than its glass transition temperature in atmospheric pressure upon application of pressure by contacting a compressible fluid.

The pressure-plastic material is described in detail with reference to FIG. 1. FIG. 1 is a graph showing a relation between the glass transition temperature of the pressure-plastic material (vertical axis) and the pressure of carbon dioxide as the compressible fluid (lateral axis). As shown in FIG. 1, the glass transition temperature of the pressure-plastic material negatively correlates with the pressure. Thus, a material, the glass transition temperature of which negatively correlates with the pressure, is regarded as the pressure-plastic material. The slope of the Tg-pressure graph depends on the composition and molecular weight of the pressure-plastic material. For example, the crystalline polyester resin for use in exemplary embodiments has a slope of −2° C./MPa. Preferably, the crystalline polyester resin for use in exemplary embodiments has a slope of −1° C./MPa or less, more preferably −5° C./MPa or less. When the slope is too large, it means that the pressure-plastic material cannot sufficiently plasticize even upon application of pressure and cannot reduce its viscosity. Such a material is not suitable for granulation.

Details of release agents for use in exemplary embodiments are described below. Specific examples of suitable release agents include, but are not limited to, waxes. Specific examples of suitable waxes include, but are not limited to, low-molecular-weight polyolefin waxes, synthetic hydrocarbon waxes, natural waxes, petroleum waxes, higher fatty acids and metal salts thereof, higher fatty acid amides, and modified waxes thereof. Two or more of these materials can be used in combination.

Specific examples of the low-molecular-weight polyolefin waxes include, but are not limited to, low-molecular-weight polyethylene wax and low-molecular-weight polypropylene wax. Specific examples of the synthetic hydrocarbon waxes include, but are not limited to, Fischer-Tropsch wax. Specific examples of the natural waxes include, but are not limited to, bees wax, carnauba wax, candelilla wax, rice wax, and montan wax. Specific examples of the petroleum waxes include, but are not limited to, paraffin wax and microcrystalline wax. Specific examples of the higher fatty acids include, but are not limited to, stearic acid, palmitic acid, and myristic acid.

The release agent preferably has a melting point of 40 to 160° C., more preferably 50 to 120° C., and most preferably 60 to 90° C. When the melting point is too low, heat-resistant storage stability of the resulting toner may be deteriorated. When the melting point is too high, the resulting toner may cause cold offset when fixed at low temperatures. The cold offset is an undesirable phenomenon in which a part of a toner image on paper is transferred onto a fixing roller by adhesive force or electrostatic adsorptive force due to insufficient melting of the toner image at an interface with the paper.

Figure 2:
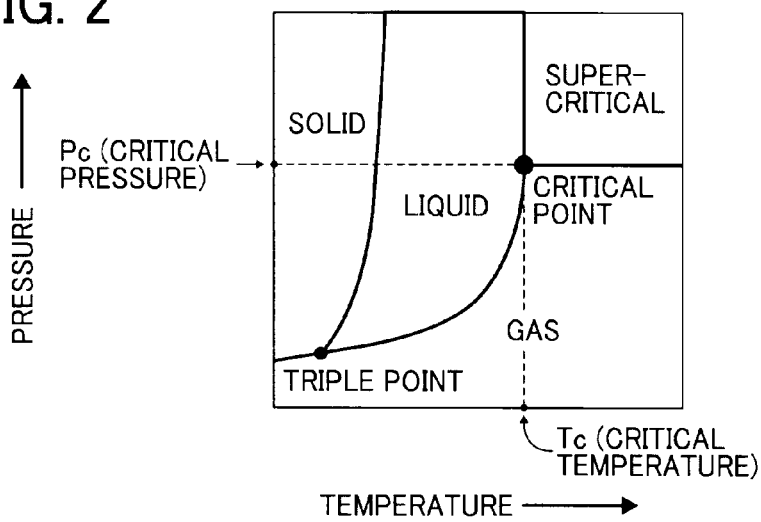
FIG. 2 is a typical pressure-temperature phase diagram showing conditions of a substance.
Figure 3:
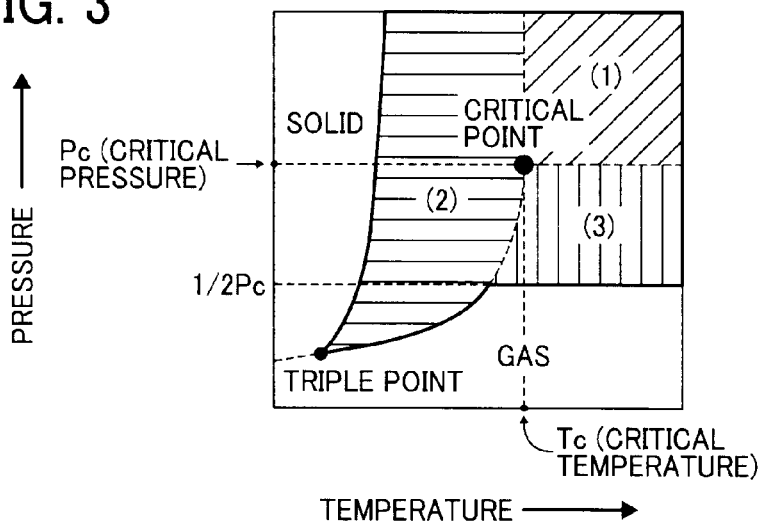
FIG. 3 is a pressure-temperature phase diagram for defining a compressible fluid for use in exemplary embodiments.

Details of compressible fluids for use in exemplary embodiments are described below with reference to FIG. 2 and FIG. 3. FIG. 2 is a typical pressure-temperature phase diagram showing conditions of a substance. FIG. 3 is a pressure-temperature phase diagram for defining the compressible fluid for use in exemplary embodiments.

The compressible fluid is defined as a substance existing in any of the phases (1), (2), or (3) in FIG. 3. It is known that substances in these phases have a very high density and behave differently from those in normal-temperature and normal-pressure conditions. A substance existing in the phase (1) is a supercritical fluid. The supercritical fluid is defined as a substance existing as a noncondensable high-density fluid in pressure-temperature phases beyond the critical point (i.e., the limit of coexistence of liquid and gas). The supercritical fluid does not cause condensation by compression, and has a temperature equal to or above the critical temperature (Tc) and a pressure equal to or above the critical pressure (Pc). A substance existing in the phase (2) is a liquid, in particular, a liquefied gas (a liquefied fluid) obtained by compressing a gaseous substance at a normal temperature (25° C.) and a normal pressure (1 atmospheric pressure). A substance existing in the phase (3) is a gas, in particular, a high-pressure gas (a subcritical fluid) having a pressure of ½Pc or more. Carbon dioxide as the compressible fluid preferably has a pressure of 3.7 MPa or more, more preferably 5 MPa or more, and most preferably equal to or above the critical pressure of 7.4 MPa.

The compressible fluid may be, for example, a supercritical fluid, a subcritical fluid, or a liquefied fluid, all of which are in a fluid state under pressure. Specific examples of the compressible fluid include, but are not limited to, supercritical carbon dioxide, liquefied carbon dioxide, methane gas, supercritical methane, ethane gas, supercritical ethane, supercritical propane, liquefied propane, propane gas, supercritical butane, liquefied butane, and butane gas. Among these substances, supercritical carbon dioxide, subcritical carbon dioxide, and liquefied carbon dioxide are preferable. Additionally, a mixture high-pressure gas or a mixture supercritical fluid in which two or more of the above substances are mixed is also preferable.

The supercritical fluid has an intermediate nature between gas and liquid. The mass transfer rate and heat transfer rate of the supercritical fluid are high and the viscosity thereof is low. The supercritical fluid can continuously and drastically alter its density, permittivity, solubility parameter, and free volume by varying temperature and pressure. The supercritical fluid can wet even a micro undulating surface because of having an extremely smaller interfacial tension than organic solvents.

Preferably, the critical temperature and pressure of the supercritical fluid are as low as possible. High-pressure liquids and high-pressure gases existing at temperatures and pressures near the critical point are preferable as the subcritical fluid.

Specific examples of the supercritical fluid or subcritical fluid include, but are not limited to, carbon monoxide, carbon dioxide, dinitrogen monoxide, ammonia, nitrogen, methane, ethane, propane, normal butane, isobutane, normal pentane, and chlorotrifluoromethane. Among these substances, carbon dioxide, having a critical pressure of 7.3 MPa and a critical temperature of 31° C., is preferable because it can be easily brought into a supercritical state, and is highly safe due to its noncombustibility. When carbon dioxide is used as a non-aqueous solvent in a toner producing method to be described in detail later, toner particles having a hydrophobic surface are obtained while the carbon dioxide is easily collected or recycled only by returning to normal pressure. Advantageously, the resultant toner particles do not need drying, no waste liquid is produced, and no residual monomer remains in the toner particles.

These supercritical fluids and subcritical fluids can be used alone or in combination. An entrainer may be added to the supercritical fluids and subcritical fluids, if necessary. Specific examples of the entrainer include, but are not limited to, alcohols (e.g., methanol, ethanol, propanol), ketones (e.g., acetone, methyl ethyl ketone), toluene, ethyl acetate, and tetrahydrofuran.

Specific examples of the liquefied fluid include, but are not limited to, liquefied carbon dioxide, liquefied methane, liquefied ethane, liquefied propane, and liquefied butane. Among these substances, liquefied carbon dioxide is preferable because of being highly safe due to its noncombustibility. These liquefied fluids can be used alone or in combination.

The compressible fluid is easily separable from a targeted product and is collectible and recyclable. Therefore, the use of the compressible fluid provides a novel low-environmental-load method of producing particles without using water or organic solvent.

Figure 4:
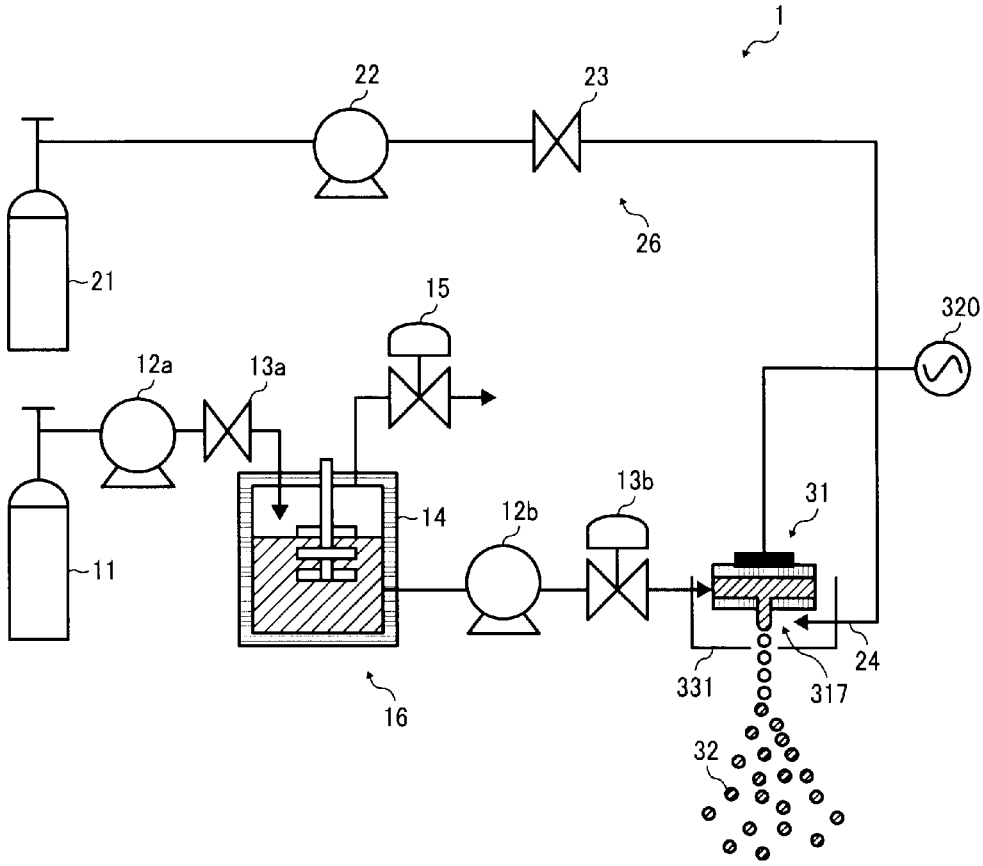
FIG. 4 is a schematic view illustrating a particle producing apparatus according to exemplary embodiments.

Details of a particle producing apparatus according to exemplary embodiments are described below. FIG. 4 is a schematic view illustrating a particle producing apparatus 1 according to exemplary embodiments. The particle producing apparatus 1 includes a melt supplier 16 that supplies a melt of a crystalline polyester resin or release agent, a discharger 31 that discharges the melt, and a particle forming member 331 defining a space within which the discharged melt is formed into particles. The melt is prepared by contacting the compressible fluid with the crystalline polyester resin or release agent. The melt supplier 16 includes a cylinder 11, pumps 12*a* and 12*b*, valves 13*a* and 13*b*, a high pressure cell 14 equipped with a thermostat, and a back pressure valve 15, all of which are connected by ultrahigh pressure pipes to form a first path. The particle forming member 331 has a pressure controller 26 including a cylinder 21, a pump 22, a valve 23, and a supply pipe 24, all of which are connected by ultrahigh pressure pipes to form a second path. The discharger 31 includes a signal generator 320 and a through hole 317.

Details of the melt supplier 16 are described below. The cylinder 11 on the first path is a pressure-resistant container that stores and supplies a substance (e.g., carbon dioxide) to be brought into a compressible fluid state in the high pressure cell 14. The substance stored in the cylinder 11 may be either gas or liquid so long as the substance can be brought into a compressible fluid state in the high pressure cell 14 under thermal control. The substance stored in the cylinder 11 may be, for example, air, nitrogen, and carbon dioxide. Among these substances, carbon dioxide is preferable in terms of cost and safety. The pump 12*a* pumps the substance stored in the cylinder 11. The valve 13*a* opens and closes the path between the pump 12*a* and the high pressure cell 14 to control the flow rate or to block the path.

The high pressure cell 14 converts the substance supplied through the valve 13*a* into a compressible fluid by heating. Also, the high pressure cell 14 produces a melt of a crystalline polyester resin or release agent by contacting the crystalline polyester resin or release agent with the compressible fluid. The inner pressure of the high pressure cell 14 is controlled by the back pressure valve 15. The high pressure cell 14 may be equipped with an agitator for agitating and mixing the compressible fluid and the crystalline polyester resin or release agent.

The pump 12*b* pumps the melt in the high pressure cell 14. The valve 13*b* opens and closes the path between the pump 12*b* and the discharger 31 to control the flow rate of the melt or to block the path. The through hole 317 is a penetrated space for discharging the melt supplied from the first path.

The cylinder 21 on the second path is a pressure-resistant container that stores and supplies a second compressible fluid such as a gas and a liquid. The second compressible fluid stored in the cylinder 21 may be, for example, air, nitrogen, and carbon dioxide. Among these substances, carbon dioxide is preferable in terms of cost and safety. The pump 22 pumps the compressible fluid stored in the cylinder 21. The valve 23 opens and closes the path between the pump 22 and the discharger 31 to control the flow rate of the compressible fluid or to block the path. The compressible fluid supplied from the second path is to be cooled in the discharger 31 due to the Joule-Thompson effect. Therefore, preferably, the compressible fluid is brought into a supercritical fluid state while being sufficiently heated.

Figure 5:
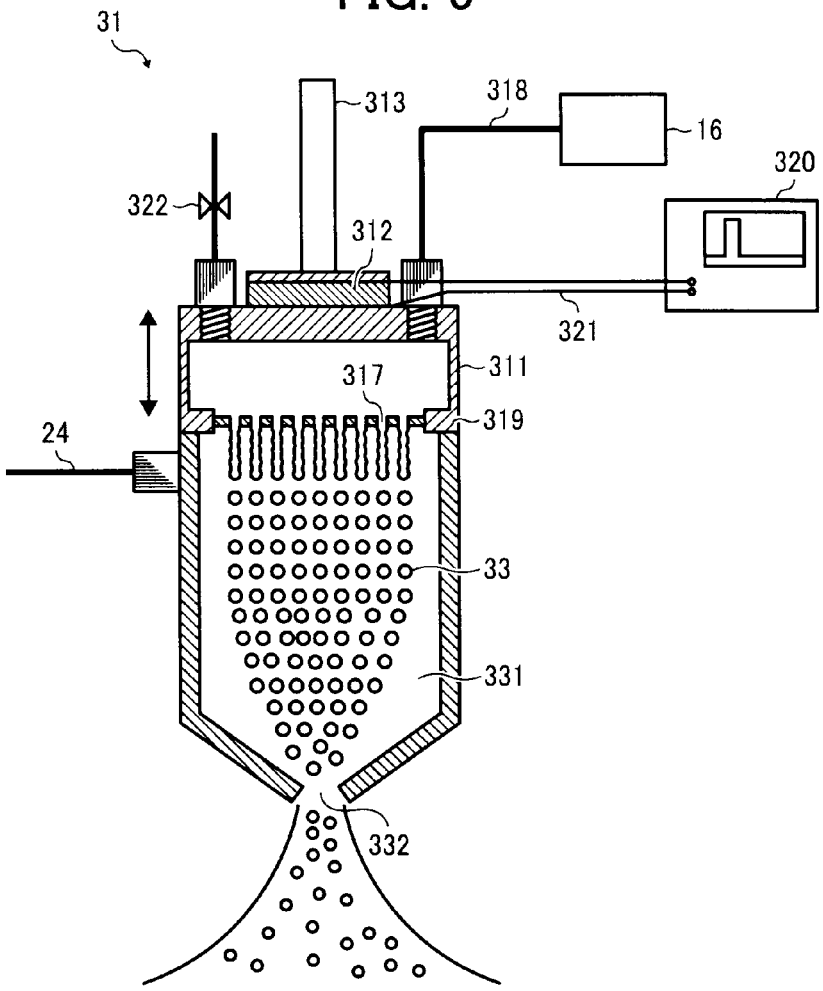
FIG. 5 is a schematic view illustrating a discharger and a particle forming member included in the particle producing apparatus.

Details of the discharger 31 and the particle forming member 331 are described below with reference to FIG. 5. FIG. 5 is a schematic view illustrating the discharger 31 and the particle forming member 331. The discharger 31 includes a storage 311 that stores the melt of a crystalline polyester resin or release agent, one or more through holes 317 disposed on a wall of the storage 311, a vibrator 312 disposed in contact with the storage 311 to vibrate the through holes 317, a signal generator 320 connected to the vibrator 312 by a conductive wire 321, and a support 313 that supports the vibrator 312. The melt of a crystalline polyester resin or release agent is supplied to the storage 311 through the valve 13*b* illustrated in FIG. 4, and is discharged from the through holes 317 toward a space defined by the particle forming member 331. The discharger 31 includes a single vibrator 312 and one or more through holes 317. The vibrator 312 is in contact with the storage 311 so as to vibrate the through holes 317. Such a configuration makes it possible that the storage 311 and the through holes 317 are externally vibrated while putting the vibrator 312 in normal-pressure conditions. In other words, high-pressure fluids can be formed into particles without any special vibrator.

As described above, the melt supplier 16 supplies the melt of a crystalline polyester resin or release agent to the storage 311 in the discharger 31 so that the melt is discharged from the through holes 317.

The storage 311 as well as pipes connected to the storage 311 is required to keep the melt at high pressures. Therefore, preferably, they are made of a metallic material such as SUS (stainless steel) to be resistant to a pressure of at least 30 MPa. The storage 311 is connected with a supply pipe 318 from which the melt is supplied. The storage 311 has a support 319 that supports a plate on which the through holes 317 are disposed. The vibrator 312 is in contact with the storage 311 so as to vibrate the entirety of the storage 311. The vibrator 312 is connected to the signal generator 320 by the conductive wire 321. Vibration of the vibrator 312 is controlled by signal generated from the signal generator 320. The storage 311 has an open valve 322 that controls the inner pressure of the storage 311 so that the melt is reliably formed into a column (hereinafter "columnar melt").

In terms of uniform vibration, the entirety of the storage 311 including the through holes 317 is preferably vibrated by a single vibrator 312. The vibrator 312 is required to reliably vibrate the storage 311, preferably at a constant vibration number (i.e., frequency). A piezoelectric body is preferable as the vibrator 312. The piezoelectric body is capable of vibrating the through holes at a constant frequency by stretching.

The piezoelectric body converts electric energy into mechanical energy. More specifically, the piezoelectric body expands and contracts when supplied with a voltage, and the through holes can be vibrated by the expansion and contraction. The piezoelectric body may be, for example, a piezoelectric ceramics such as lead zirconate titanate (PZT). Because of having a small displacement, the piezoelectric body is generally laminated. Additionally, piezoelectric polymers such as polyvinylidene fluoride (PVDF), crystals, and single crystals of LiNbO3, LiTaO3, and KNbO3 are also usable.

To produce extremely-uniformly-sized micro particles of the melt (hereinafter "particulate melt"), the frequency of the piezoelectric body is preferably 20 kHz to 10 MHz, and more preferably 50 kHz to 1 MHz. When the frequency is too small, productivity of the particulate melt may be poor. When the frequency is too large, it may be difficult to control size of the particulate melt.

The vibrator 312 is in contact with the storage 311 including a plate having the through holes 317. To uniformly vibrate a columnar melt discharged from the through hole 317, the vibrator 312 and the plate having the through holes 317 are preferably disposed in parallel. Even when they become deformed by the vibration, the angle therebetween is preferably kept 10° or less. In terms of productivity, two or more storages 311 each including the vibrator 312 are preferably provided.

The support 313 fixes the storage 311 and the vibrator 312 to the discharger 31. The support 313 is preferably made of a rigid material such as a metal. The support 313 may partially have a vibration relaxing member such as a rubber and a resin, so as not to cause undesirable resonance which may generate disturbed vibration in the storage 311.

Each of the through holes 317 is a penetrated space for discharging the melt supplied from the first path. A material on which the through holes 317 are formed may be, for example, stainless steel (SUS), nickel, copper, aluminum, iron, or titanium. In terms of corrosion resistance, stainless steel (SUS) and nickel are preferable. The material on which the through holes 317 are formed preferably has a thickness of 5 to 100 μm. When the thickness is too large, it may be difficult to form the through holes 317. When the thickness is too small, such a material may fracture due to the pressure difference between an inside of the storage 311 and the space defined by the particle forming member 331. Since processability of a material depends on the nature of the material, the preferable thickness is not limited to the above-described range unless the through holes 317 can be formed without degrading durability of the material.

The opening diameter of the through hole 317 is not limited to any particular number unless the discharge pressure is kept constant. When the opening diameter is too small, the melt may clog the through hole 317, preventing formation of particles with a targeted size. Preferably, the opening diameter of the through hole 317 is 2 μm or more, more preferably 5 μm or more, and most preferably 8 μm or more. In this case, extremely-uniformly-sized micro particles of the melt are produced at a set frequency while preventing fine substances having a diameter of 1 μm or less from clogging. This is because the frequency range within which the particulate melt can be reliably obtained is reduced as the opening diameter of the through hole becomes greater. The opening diameter is defined as a diameter when the through hole 317 has a true circle shape, and a short diameter when the through hole 317 has an oval shape.

The number of the through holes 317 is one or more. To effectively produce extremely-uniformly-sized micro particles, preferably, the number of the through holes 317 is two or more. The number of through holes 317 provided to a single storage 311, vibrated by a single vibrator 312, is preferably 10 to 10,000 in terms of productivity and controllability, and 10 to 1,000 in terms of reliable production of extremely-uniformly-sized micro particles of the melt. The productivity of toner particles is represented by the product of the number of micro particles generated per unit time (i.e., frequency), the number of vibrators 312, and the number of through holes 317 vibrated by a single vibrator 312. In terms of operability, the number of the through holes 317 provided to a single storage 311 vibrated by a vibrator 312 is as large as possible.

Figure 6:
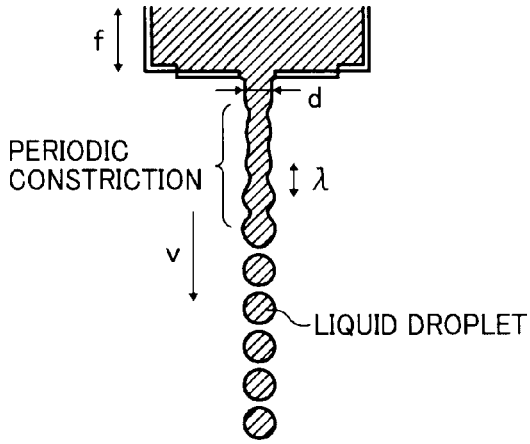
FIG. 6 is an explanatory drawing for particle formation phenomenon in the particle producing apparatus.

How the melt is formed into particles by vibration is explained with reference to FIG. 6. FIG. 6 is an explanatory drawing for particle formation phenomenon. When the melt is discharged from the through hole with a relatively small pressure, the melt is formed into a column immediately after the discharging and the column is separated into particles. In this case, the particles have a wide size distribution. To solve this problem and provide uniformly-sized particles, in the present embodiment, a vibration λ is periodically given to the column. As a result, periodic constrictions appear in the column and the column is constricted and separated into uniformly-sized particles.

Rayleigh fission is known as a phenomenon in which a liquid column is separated into uniform liquid droplets. In Rayleigh fission, a wavelength λ, at which a liquid column becomes most unstable is represented by the following equation (1):

$$\lambda=4.5d \tag{1}$$

wherein d represents a diameter of the liquid column. A frequency f of a generated disturbance is represented by the following equation (2):

$$f=v/\lambda \tag{2}$$

wherein v represents a velocity of the liquid column. It is experimentally known that uniformly-sized liquid droplets can be stably formed when the following relationship (3) is satisfied:

$$3.5<\lambda/d<7.0 \tag{3}$$

The above formulae (1) to (3) are satisfied in the present embodiment. These are beneficial to estimate optimum conditions for obtaining desired particles.

The particle forming member 331 defines a space within which the melt discharged from the through holes 317 is applied with a predetermined pressure. The melt is formed into a columnar melt and the columnar melt is constricted and separated into particles in the space. The particle forming member 331 has the pressure controller 26 that controls the inner pressure difference between the space and the storage 311 so that the melt discharged from the through hole 317 is formed into a columnar melt and the columnar melt is constricted and separated into particles. The pressure inside the storage 311 is set higher than the pressure in the vicinity of the through holes 317 in the space so that the melt is discharged from the through holes 317 due to the pressure difference therebetween. The melt should keep in a columnar shape before constricted and separated into particles by a constant vibration. Therefore, the pressure in the vicinity of the through holes 317 in the space should be not so different from the pressure in the storage 311. In case the pressure difference is too large, the compressible fluid may rapidly evaporate at the time the melt is discharged from the through holes while releasing pressure, resulting in solidification of the discharged columnar melt without being constricted. Too large a pressure difference may further cause fracture of the through holes 317.

Thus, a proper pressure difference is set between in the storage 311 and in the vicinity of the through holes 317 in the space defined by the particle forming member 331 in the discharger 31. Accordingly, the discharger 31 may have a double-pipe configuration in which the storage 311 is completely covered with the particle forming member 331, for example. Alternatively, when formed with a pressure-resistant SUS (stainless steel), the discharger 31 may have a configuration in which the particle forming member 331 is provided at the end of the storage 311 having the same diameter, and the second compressible fluid is supplied to the space defined by the particle forming member 331 from the supply pipe 24, as illustrated in FIG. 5, to make its weight as light as possible. The vibrator 312 is fixed to, for example, a top board of the discharger 31 by the support 313, and simultaneously vibrates the storage 311, the through holes 317, the particle forming member 331, and the melt in the vertical direction. Therefore, both the supply pipe 318 on the first path and the supply pipe 24 on the second path are freely movable so as not to disturb vibration of the vibrator 312. When the storage 311 is supplied with an excessive amount of the melt, the melt can be flowed back through the open valve 322 while controlling the inner pressure. When the supply amount to the storage 311 and the discharge amount from the storage 311 are the same, the open valve 322 is closed.

Details of a melting process in a particle producing method according to exemplary embodiments are described below with reference to FIG. 4. In the melting process, the first compressible fluid is melted in a crystalline polyester resin or release agent to produce a melt of the crystalline polyester resin or release agent. The melt of a crystalline polyester resin or release agent is defined as the crystalline polyester resin or release agent which has been plasticized and liquefied while swelling, by contact with the compressible fluid. In a well-known RESS (Rapid Expansion of Supercritical Solution) method, a material to be discharged is uniformly dissolved in a compressible fluid. On the other hand, in the method according to exemplary embodiment, as described above, a material to be discharged (a crystalline polyester resin or release agent) is merely swollen by contact with a compressible fluid while reducing its viscosity. An interface exists between the resulting melt of the crystalline polyester resin or release agent and the compressible fluid. Thus, the condition of the material to be discharged is different between the RESS method and the method according to exemplary embodiments. The material to be discharged is in a compressible fluid—solid equilibrium in the RESS method, while the material is in a gas—liquid equilibrium in the method according to exemplary embodiments.

In the melting process, first, a raw material, i.e., a crystalline polyester resin or release agent, is contained in the high pressure cell 14. When multiple kinds of raw materials are contained, the raw materials may be previously mixed by a mixer, for example, and may be further melt-kneaded by a roll mill, for example. After sealing the high pressure cell 14, the raw material is agitated by an agitator while the pump 12*a* supplies the first compressible fluid (e.g., carbon dioxide) from the cylinder 11 to the high pressure cell 14 through the valve 13*a*. The inner temperature of the high pressure cell 14 is adjusted by the thermostat, and the inner pressure thereof is adjusted by the pump 12*a* and the back pressure valve 15. Thus, the compressible fluid can be brought into contact with the raw material including the crystalline polyester resin or release agent. The compressible fluid is then melted in the crystalline polyester resin or release agent, thus reducing the viscosity of the crystalline polyester resin or release agent. The agitation is kept until the melt has a constant viscosity.

When the raw material is a crystalline polyester resin, the viscosity of the melt is as low as possible, preferably 20 mPa·s or less, so that the melt can be reliably discharged from the through holes 317. When the viscosity is too large, it may be difficult to form the melt into particles, or the resulting particles may include coarse particles or undesired fibrous, foamed, or coalesced substances.

When the raw material is a release agent, the viscosity of the melt is very low, preferably 1 mPa·s or less. Conventionally, a melt of a release agent is formed by heating the release agent to above its melting point under atmospheric pressure without contacting a compressible fluid. In the present embodiment, a release agent is melted by contact with a compressible fluid at a temperature 10 to 20° C. lower than the melting point under atmospheric pressure, due to the occurrence of depression of the melting point.

In the melting process, the compressible fluid is preferably applied with a pressure of 1 MPa or more, more preferably 2 to 200 MPa, and most preferably 5 to 100 MPa. When the compressible fluid is applied with too small a pressure, the raw material may not be given enough plasticity to be formed into particles even being fluidized. No higher limit is set to the pressure, but a higher pressure generally requires a higher-cost massive equipment.

In the melting process, the crystalline polyester resin or release agent is preferably plasticized at a temperature equal to or less than the decomposition temperature thereof, more preferably the melting point thereof, under atmospheric temperature. The decomposition temperature is defined as a temperature at which a sample starts decreasing its weight due to the occurrence of thermal decomposition in a measurement by a thermo gravimetry analyzer (TGA).

When the plasticizing temperature exceeds the decomposition temperature, the crystalline polyester resin or release agent may deteriorate. For example, durability or releasability is degraded, molecular weight is reduced by cutting of molecular chains, the color or transparency is reduced by oxidation, fixability, heat-resistant storage stability, and/or chargeability of the resultant toner are degraded, or a large amount of energy is consumed in the heating treatment.

Details of a granulation process in a particle producing method according to exemplary embodiments are described below. In the granulation process, the melt produced in the melting process is then discharged from the through holes by vibration to form particles of the melt.

The pump 22 supplies the second compressible fluid (e.g., carbon dioxide) from the cylinder 21 to an opening 332 through the valve 23 and the supply pipe 24. The compressible fluid is heated by a heater. Operation conditions are adjusted so that the compressible fluid can keep constant temperature and pressure. On the other hand, the pump 12*b* supplies the melt of the crystalline polyester resin or release agent, in which the compressible fluid is melted in the high pressure cell 14, to the through holes 317 through the valve 13*b*. The melt is discharged from the through holes 317 due to the pressure difference. The inner temperature and pressure of the high pressure cell 14 are kept constant by control of the pump 12*a*, the back pressure valve 15, and the thermostat.

The melt in the storage 311 is discharged from the through holes 317 into the space defined by the particle forming member 331 keeping a pressure capable of forming a columnar melt immediately after the discharging. Constrictions appear in the columnar melt due to the vibration transmitted from the storage 311, and the columnar melt then splits from the constriction into particles 33 of the melt by the occurrence of the Rayleigh fission.

The pressure in the space defined by the particle forming member 331 is not limited to any particular value so long as the melt can be discharged from the through holes 317, and is decided in view of viscosity of the melt or discharging pressure. For example, when the melt has a viscosity of 3 mPa·s, the pressure in the storage 311 is set to about 65 MPa, and therefore the pressure in the vicinity of the through holes 317 in the space defined by the particle forming member 331 is set to less than 65 MPa.

The pressure difference between in the storage 311 and in the vicinity of the through holes 317 in the space defined by the particle forming member 331 is preferably 500 KPa or less, and more preferably 200 KPa or less, in view of discharging speed. To keep the pressure difference constant, the pressure of the melt supplied from the first path and the pressure of the second compressible fluid supplied from the second path may be independently controlled. The pressure difference also depends on the entire length of the particle forming member 331 and the opening diameter of the opening 332 disposed on a bottom of the discharger 31. For example, even when the pressure of the melt supplied from the first path and the pressure of the second compressible fluid supplied from the second path are equal, the pressure within the space defined by the particle forming member 331 is released to atmosphere through the opening 332 and becomes smaller than the pressure in the storage 311. In a case in which the pressure difference is extremely large depending on apparatus configuration, the pressure of the second compressible fluid supplied from the second path may be made greater than the pressure of the melt supplied from the first path so that a proper pressure difference is achieved. Since the pressures vary with time very little, it is possible to operate the apparatus at a constant pressure condition.

In terms of apparatus maintenance, it is effective to monitor the pressure in the space defined by the particle forming member 331 for the purpose of feedback control. The particles formed in the space defined by the particle forming member 331 are completely solidified at the bottom of the space or after releasing of the pressure into atmosphere due to rapid depression of the pressure. Thus, coalescence of the particles can be prevented. Further, the particles are rapidly discharged from the opening 332 to a free space due to the pressure difference, resulting in formation of complete particles. The above-described method produces particles having an extremely narrow size distribution. Specifically, a columnar raw material is separated into uniformly-sized particles by the occurrence of the Rayleigh fission while coalescence of the uniformly-sized particles is prevented by rapid solidification of the particles.

A toner according to exemplary embodiments includes the particles of the crystalline polyester resin and/or release agent obtained by the above-described method. Such a toner can be produced by a method in which a toner composition including a dispersion of the above-prepared particles of the crystalline polyester resin and/or release agent is formed into liquid droplets in a gaseous phase, or a method in which the toner composition is formed into particles in a liquid phase.

First, the method in which the toner composition is formed into liquid droplets in a gaseous phase is described in detail.

The toner composition includes a dispersion of the particles of the crystalline polyester resin and/or release agent, and other materials usable for typical electrophotographic toner. For example, the toner composition may include a binder resin such as a styrene-acrylic resin, a polyester resin, a polyol resin, and an epoxy resin, a colorant, and a release agent. The toner composition may further include other materials, such as a charge controlling agent, a magnetic material, a fluidizer, a lubricant, a cleaning auxiliary agent, and a resistivity controlling agent, if needed. The toner composition is dissolved or dispersed in a solvent such as an organic solvent to prepare a toner composition liquid. The toner composition liquid is discharged from through holes to be formed into liquid droplets. The liquid droplets of the toner composition liquid are further dried and solidified in a gaseous phase to obtain toner particles. Alternatively, the toner composition may be previously melt-kneaded, and the melt-kneaded composition is dissolved or dispersed in a solvent. The resulting toner composition liquid is formed into liquid droplets, and the liquid droplets are dried and solidified to be toner particles.

Specific examples of usable binder resins include, but are not limited to, vinyl homopolymers and copolymers of styrene monomers, acrylic monomers, and/or methacrylic monomers, polyester polymers, polyol resins, phenol resins, silicone resins, polyurethane resins, polyamide resins, furan resins, epoxy resins, xylene resins, terpene resins, coumarone indene resins, polycarbonate resins, and petroleum resins.

Specific examples of the styrene monomers include, but are not limited to, styrene, o-methylstyrene, m-methylstyrene, p-methylstyrene, p-phenylstyrene, p-ethylstyrene, 2,4-dimethylstyrene, p-n-amylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, p-nitrostyrene, and derivatives thereof.

Specific examples of the acrylic monomers include, but are not limited to, acrylic acids and esters thereof such as methyl acrylate, ethyl acrylate, propyl acrylate, n-butyl acrylate, isobutyl acrylate, n-octyl acrylate, n-dodecyl acrylate, 2-ethylhexyl acrylate, stearyl acrylate, 2-chloroethyl acrylate, and phenyl acrylate.

Specific examples of the methacrylic monomers include, but are not limited to, methacrylic acids and esters thereof such as methyl methacrylate, ethyl methacrylate, propyl methacrylate, n-butyl methacrylate, isobutyl methacrylate, n-octyl methacrylate, n-dodecyl methacrylate, 2-ethylhexyl methacrylate, stearyl methacrylate, phenyl methacrylate, dimethylaminoethyl methacrylate, and diethylaminoethyl methacrylate.

The vinyl homopolymers and copolymers may be formed from the following monomers (1) to (18).

(1) Monoolefins, such as ethylene, propylene, butylene, and isobutylene.

(2) Polyenes, such as butadiene and isoprene.

(3) Vinyl halides, such as vinyl chloride, vinylidene chloride, vinyl bromide, and vinyl fluoride.

(4) Vinyl esters, such as vinyl acetate, vinyl propionate, and vinyl benzoate.

(5) Vinyl ethers, such as vinyl methyl ether, vinyl ethyl ether, and vinyl isobutyl ether.

(6) Vinyl ketones, such as vinyl methyl ketone, vinyl hexyl ketone, and methyl isopropenyl ketone.

(7) N-Vinyl compounds, such as N-vinyl pyrrole, N-vinyl carbazole, N-vinyl indole, and N-vinyl pyrrolidone.

(8) Vinylnaphthalenes.

(9) Acrylic acid and methacrylic acid derivatives, such as acrylonitrile, methacrylonitrile, and acrylamide.

(10) Unsaturated dibasic acids, such as maleic acid, citraconic acid, itaconic acid, alkenyl succinic acid, fumaric acid, and mesaconic acid.

(11) Unsaturated dibasic acid anhydrides, such as maleic acid anhydride, citraconic acid anhydride, itaconic acid anhydride, and alkenyl succinic acid anhydride.

(12) Monoesters of unsaturated dibasic acids, such as maleic acid monomethyl ester, maleic acid monoethyl ester, maleic acid monobutyl ester, citraconic acid monomethyl ester, citraconic acid monoethyl ester, citraconic acid monobutyl ester, itaconic acid monomethyl ester, alkenyl succinic acid monomethyl ester, fumaric acid monomethyl ester, and mesaconic acid monomethyl ester.

(13) Unsaturated dibasic acid esters, such as dimethyl maleic acid and dimethyl fumaric acid.

(14) α,β-Unsaturated acids, such as crotonic acid and cinnamic acid.

(15) α,β-Unsaturated acid anhydrides, such as crotonic acid anhydride and cinnamic acid anhydride.

(16) Carboxyl-group-containing monomers, such as anhydrides between α,β-unsaturated acids and lower fatty acids;

and alkenyl malonic acid, alkenyl glutaric acid, alkenyl adipic acid, and anhydrides and monoesters thereof.

(17) Hydroxyalkyl esters of acrylic acids and methacrylic acids, such as 2-hydroxyethyl acrylate, 2-hydroxyethyl methacrylate, and 2-hydroxypropyl methacrylate.

(18) Hydroxyl-group-containing monomers, such as 4-(1-hydroxy-1-methylbutyl)styrene and 4-(1-hydroxy-1-methylhexyl)styrene.

The vinyl homopolymers and copolymers may include a cross-linking structure formed from a cross-linking agent having 2 or more vinyl groups. Specific examples of such cross-linking agents include, but are not limited to, aromatic divinyl compounds such as divinylbenzene and divinylnaphthalene. Diacrylate compounds in which acrylates are bonded with an alkyl chain are also usable, such as ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, ethylene glycol dimethacrylate, 1,3-butylene glycol dimethacrylate, 1,4-butanediol dimethacrylate, 1,5-pentanediol dimethacrylate, 1,6-hexanediol dimethacrylate, and neopentyl glycol dimethacrylate. Diacrylate compounds in which acrylates are bonded with an ether bond are also usable, such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, diethylene glycol dimethacrylate, triethylene glycol dimethacrylate, tetraethylene glycol dimethacrylate, polyethylene glycol #400 dimethacrylate, polyethylene glycol #600 dimethacrylate, and dipropylene glycol dimethacrylate. Diacrylate and dimethacrylate compounds in which acrylates and methacrylates, respectively, are bonded with a chain having an aromatic group and an ether bond are also usable. A commercially-available polyester-based diacrylate MANDA (from Nippon Kayaku Co., Ltd.) is also usable.

Additionally, polyfunctional cross-linking agents are also usable, such as pentaerythritol triacrylate, trimethylolethane triacrylate, trimethylolpropane triacrylate, tetramethylolmethane tetraacrylate, oligo ester acrylate, pentaerythritol trimethacrylate, trimethylolethane trimethacrylate, trimethylolpropane trimethacrylate, tetramethylolmethane tetramethacrylate, oligo ester methacrylate, triallyl cyanurate, and triallyl trimellitate.

The amount of the cross-linking agent is preferably 0.01 to 10 parts by weight, more preferably 0.03 to 5 parts by weight, based on 100 parts by weight of the monomer. Among the above-described cross-linking agents, aromatic divinyl compounds (preferably divinylbenzene) and diacrylate compounds in which acrylates are bonded with a chain having an aromatic group and an ether bond are preferable. In particular, combinations of a styrene copolymer and a styrene-acrylic copolymer are preferable.

The vinyl homopolymers and copolymers are obtained using a polymerization initiator. Specific examples of usable polymerization initiators include, but are not limited to, 2,2'-azobis isobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobis isobutyrate, 1,1'-azobis(1-cyclohexanecarbonitrile), 2-(carbamoylazo)-isobutyronitrile, 2,2'-azobis(2,4,4-trimethylpentane), 2-phenylazo-2',4'-dimethyl-4'-methoxyvaleronitrile, 2,2'-azobis(2-methylpropane), ketone peroxides (e.g., methyl ethyl ketone peroxide, acetyl acetone peroxide, cyclohexanone peroxide), 2,2-bis(tert-butylperoxy)butane, tert-butyl hydroperoxide, cumene hydroperoxide, 1,1,3,3-tetramethylbutyl hydroperoxide, di-tert-butyl peroxide, tert-butylcumyl peroxide, dicumyl peroxide, α-(tert-butylperoxy)isopropylbenzene, isobutyl peroxide, octanoyl peroxide, decanoyl peroxide, lauroyl peroxide, 3,5,5-trimethylhexanoyl peroxide, benzoyl peroxide, m-tolyl peroxide, di-isopropyl peroxydicarbonate, di-2-ethylhexyl peroxydicarbonate, di-n-propyl peroxydicarbonate, di-2-ethoxyethyl peroxycarbonate, di-ethoxyisopropyl peroxydicarbonate, di(3-methyl-3-methoxybutyl) peroxycarbonate, acetylcyclohexylsulfonyl peroxide, tert-butyl peroxyacetate, tert-butyl peroxyisobutyrate, tert-butyl peroxy-2-ethyl hexylate, tert-butyl peroxylaurate, tert-butyl-oxybenzoate, tert-butyl peroxyisopropyl carbonate, di-tert-butyl peroxyisophthalate, tert-butyl peroxyallyl carbonate, isoamyl peroxy-2-ethyl hexanoate, di-tert-butyl peroxyhexahydroterephthalate, and tert-butyl peroxyazelate.

THF-soluble components in a styrene-acrylic resin as the binder resin preferably have a molecular weight distribution such that at least one peak exists within a number average molecular weight range between 3,000 and 50,000 and at least one peak exists at a number average molecular weight of 100,000 or more, when measured by GPC (gel permeation chromatography), from the viewpoint of fixability, offset resistance, and storage stability of toner. The THF-soluble components preferably include components having a molecular weight of 100,000 or less in an amount of 50 to 90%. Also, the THF-soluble components preferably have a molecular weight distribution such that a maximum peak exists within a molecular weight range between 5,000 and 30,000, more preferably between 5,000 and 20,000.

The vinyl polymers (e.g., styrene-acrylic resins) as the binder resin preferably have an acid value of 0.1 to 100 mgKOH/g, more preferably 0.1 to 70 mgKOH/g, and most preferably 0.1 to 50 mgKOH/g.

The polyester polymers as the binder resin may be formed from divalent alcohols such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, and diols obtained from a reaction between a cyclic ether (e.g., ethylene oxide, propylene oxide) and bisphenol A.

To obtain a polyester polymer having cross-links, polyols having 3 or more valences may be used in combination. Specific examples of usable polyols include, but are not limited to, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Specific examples of suitable acids for preparing the polyester polymer include, but are not limited to, benzene dicarboxylic acids (e.g., phthalic acid, isophthalic acid, terephthalic acid) and anhydrides thereof, alkyl dicarboxylic acids (e.g., succinic acid, adipic acid, sebacic acid, azelaic acid) and anhydrides thereof, unsaturated dibasic acids (e.g., maleic acid, citraconic acid, itaconic acid, alkenylsuccinic acid, fumaric acid, mesaconic acid), and unsaturated dibasic acid anhydrides (e.g., maleic acid anhydride, citraconic acid anhydride, itaconic acid anhydride, alkenylsuccinic acid anhydride). Specific examples of suitable polycarboxylic acids having 3 or more valences include, but are not limited to, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, enpol trimmer acid, and anhydrides and partial lower alkyl esters of these compounds.

THF-soluble components in the polyester polymer as the binder resin preferably have a molecular weight distribution such that at least one peak exists within a number average molecular weight range between 3,000 and 50,000, when measured by GPC (gel permeation chromatography), from the viewpoint of fixability, offset resistance, and storage stability of toner. The THF-soluble components in the polyester polymer preferably include components having a molecular weight of 100,000 or less in an amount of 60 to 100%. Also, the THF-soluble components preferably have a molecular weight distribution such that at least one peak exists within a molecular weight range between 5,000 and 20,000. Molecular weight distribution of the binder resin can be measured by gel permeation chromatography (GPC) using THF as a solvent.

The polyester polymer as the binder resin preferably has an acid value of 0.1 to 100 mgKOH/g, more preferably 0.1 to 70 mgKOH/g, and most preferably 0.1 to 50 mgKOH/g.

At least one of the vinyl polymer and the polyester polymer may be formed from a monomer reactive with the other. For example, the polyester polymer may be formed from a monomer reactive with the vinyl polymer, such as an unsaturated dicarboxylic acid (e.g., phthalic acid, maleic acid, citraconic acid, itaconic acid) and anhydride thereof. For example, the vinyl polymer may be formed from a monomer such as a carboxyl-group-containing monomer, a hydroxyl-group-containing monomer, an acrylate, and a methacrylate.

When the binder resin is a mixture of two or more of these polymers, the mixture preferably includes a polymer having an acid value of 0.1 to 50 mgKOH/g in an amount of 60% by weight or more.

The binder resin and the toner composition preferably have a glass transition temperature (Tg) of 35 to 80° C., and more preferably 40 to 75° C., from the viewpoint of storage stability of the toner. When Tg is too low, the toner may easily deteriorate in high-temperature atmosphere and may cause offset when fixed on a recording medium. When Tg is too high, the toner may have poor fixability.

Colorants usable for typical toners are also usable for the toner according to exemplary embodiments.

The toner may include a colorant dispersant. The colorant dispersant preferably has high affinity for the binder resin. Specific examples of commercially available suitable colorant dispersants include, but are not limited to, AJISPER PB821 and PB822 (from Ajinomoto Fine-Techno Co., Inc.), DISPERBYK-2001 (from BYK-Chemie GmbH), and EFKA-4010 (from EFKA).

The colorant dispersant preferably has a weight average molecular weight of 500 to 100,000, more preferably 3,000 to 100,000, much more preferably 5,000 to 50,000, and most preferably 5,000 to 30,000. The weight average molecular weight is determined from a styrene-conversion molecular weight at a maximum peak in a gel permeation chromatogram. When the molecular weight is too small, it means that the polarity of the dispersant is so high that colorants cannot be finely dispersed. When the molecular weight is too large, it means that an affinity of the dispersant for solvents is so high that colorants cannot be finely dispersed.

The content of the colorant dispersant is preferably 1 to 50 parts by weight, more preferably 5 to 30 parts by weight, based on 100 parts by weight of the colorant. When the content is too small, colorant dispersibility may be poor. When the content is too large, chargeability may be poor.

A toner including the particles of the release agent obtained by the above-described method according to exemplary embodiments has an improved offset resistance. The release agent prevents toner particles from reaggregating and clogging through holes.

The toner may further include a charge controlling agent. Charge controlling agents usable for typical toners are also usable for the toner according to exemplary embodiments.

The toner may further include a fluidizer to improve fluidity. Specific preferred materials suitable for the fluidizer include, but are not limited to, fine powders of fluorocarbon resins such as vinylidene fluoride and polytetrafluoroethylene; fine powders of silica prepared by a wet process or a dry process; fine powders of titanium oxide; fine powders of alumina; and fine powders of silica, titanium oxide, and alumina which are surface-treated with a silane-coupling agent, a titanium-coupling agent, or a silicone oil. Among these materials, fine powders of silica, titanium oxide, and alumina are preferable, and fine powders of silica which are surface-treated with a silane-coupling agent or a silicone oil are more preferable. Fine powders of silica may be obtained from gas phase oxidation of silicon halides, and they are generally called as fumed silica.

Specific examples of commercially available fine powders of such silica obtained from gas phase oxidation of silicon halides include, but are not limited to, AEROSIL 130, 300, 380, TT600, MOX170, MOX80, and —COK84 (from Nippon Aerosil Co., Ltd.); CAB-O-SIL M-5, MS-7, MS-75, HS-5, and EH-5 (from Cabot Corporation); WACKER HDK N20, V15, N20E, T30, and T40 (from Wacker Chemie AG); D-C Fine Silica (from Dow Corning Corporation); and Fransol (from Fransil).

More preferably, fine powders of silica obtained from gas phase oxidation of silicon halides are hydrophobized. In particular, the hydrophobized silica preferably has a hydrophobicity degree of 30 to 80% when measured by a methanol titration test. Hydrophobicity is given by chemically or physically treating silica with an organic silicon compound which is reactive with or adsorptive to the silica. Preferably, fine powders of silica obtained from gas phase oxidation of silicon halides are treated with an organic silicon compound.

Specific examples of the organic silicon compounds include, but are not limited to, hydroxypropyltrimethoxysilane, phenyltrimethoxysilane, n-hexadecyltrimethoxysilane, n-octadecyltrimethoxysilane, vinyltrimethoxysilane, vinyltriethoxysilane, vinyltriacetoxysilane, dimethylvinylchlorosilane, divinylchlorosilane, γ-methacryloxypropyltrimethoxysilane, hexamethyldisilazane, trimethylsilane, trimethylchlorosilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilyl mercaptan, trimethylsilyl mercaptan, triorganosilyl acrylate, vinyldimethylacetoxysilane, dimethylethoxysilane, trimethylethoxysilane, trimethylmethoxysilane, methyltriethoxysilane, isobutyltrimethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units and 0 to 1 terminal silanol group. Other than the above compounds, silicone oils such as dimethyl silicone oil are also preferable. Two or more of these compounds can be used alone or in combination.

The fluidizer preferably has an average primary diameter of 0.001 to 2 μm, and more preferably 0.002 to 0.2 μm. The fluidizer preferably has a number average particle diameter of 5 to 100 nm, and more preferably 5 to 50 nm. The fluidizer preferably has a specific surface area of 30 $m^2/g$ or more, and more preferably 60 to 400 $m^2/g$, when measured by nitrogen adsorption in the BET method. The surface-treated fluidizer preferably has a specific surface area of 20 $m^2/g$ or more, and more preferably 40 to 300 $m^2/g$, when measured by nitrogen adsorption in the BET method. Preferably, the content of the fluidizer is 0.03 to 8 parts by weight based on 100 parts of the toner particles.

The toner may further include a cleanability improving agent so as to be easily removable from an image bearing member or a primary transfer medium when remaining thereon after image transfer. Specific preferred examples of suitable cleanability improving agents include, but are not limited to, metal salts of fatty acids (e.g., zinc stearate, calcium stearate) and fine particles of polymers prepared by soap-free emulsion polymerization (e.g., polymethyl methacrylate, polystyrene). Such fine particles of polymers preferably have a narrow size distribution and a volume average particle diameter of 0.01 to 1 μm.

The fluidizer and the cleanability improving agent (hereinafter "external additives") are adhered or fixed to the surface of the toner particles by a powder mixer, for example. Specific examples of usable mixers include, but are not limited to, a V-type mixer, a Rocking mixer, a Loedige mixer, a Nauta mixer, and a Henschel mixer. When fixing the external additives to the toner particles, instruments such as HIBRIDIZER, MECHANOFUSION, and Q-TYPE MIXER can be used.

The toner component is dissolved or dispersed in a solvent, preferably an organic solvent. Organic solvents having a boiling point less than 150° C. are preferable because they are easily removable. Specific preferred examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Two or more of these solvents can be used in combination. In particular, organic solvents having a solubility parameter of 8 to 9.8 $(cal/cm^3)^{1/2}$, preferably 8.5 to 9.5 $(cal/cm^3)^{1/2}$, are preferable because they can dissolve polyester resins well. Ester and ketone solvents are also preferable because they are interactive with modified groups in the release agent such that crystal growth is effectively prevented in the release agent. In particular, ethyl acetate and methyl ethyl ketone are preferable because they are easily removable.

An apparatus for producing toner by the above-described method in which the toner composition is formed into liquid droplets in a gaseous phase is described in detail. Such a toner producing apparatus includes a mechanism for discharging the toner composition liquid from through holes disposed on a thin film upon vibration of the thin film by a mechanical vibrator, so that uniformly-sized liquid droplets of the toner composition liquid are produced.

The mechanical vibrator vibrates vertically with respect to the thin film having the through holes. Thus, the mechanical vibrator may take following two alternative configurations. The first configuration is a horn-type mechanical vibrator having a vertically-vibrating surface disposed parallel to the thin film having the through holes. The second configuration is a ring-type mechanical vibrator circularly disposed around the through holes on the thin film. As an example, a toner producing apparatus including the ring-type mechanical vibrator is described in detail below.

Figure 7:
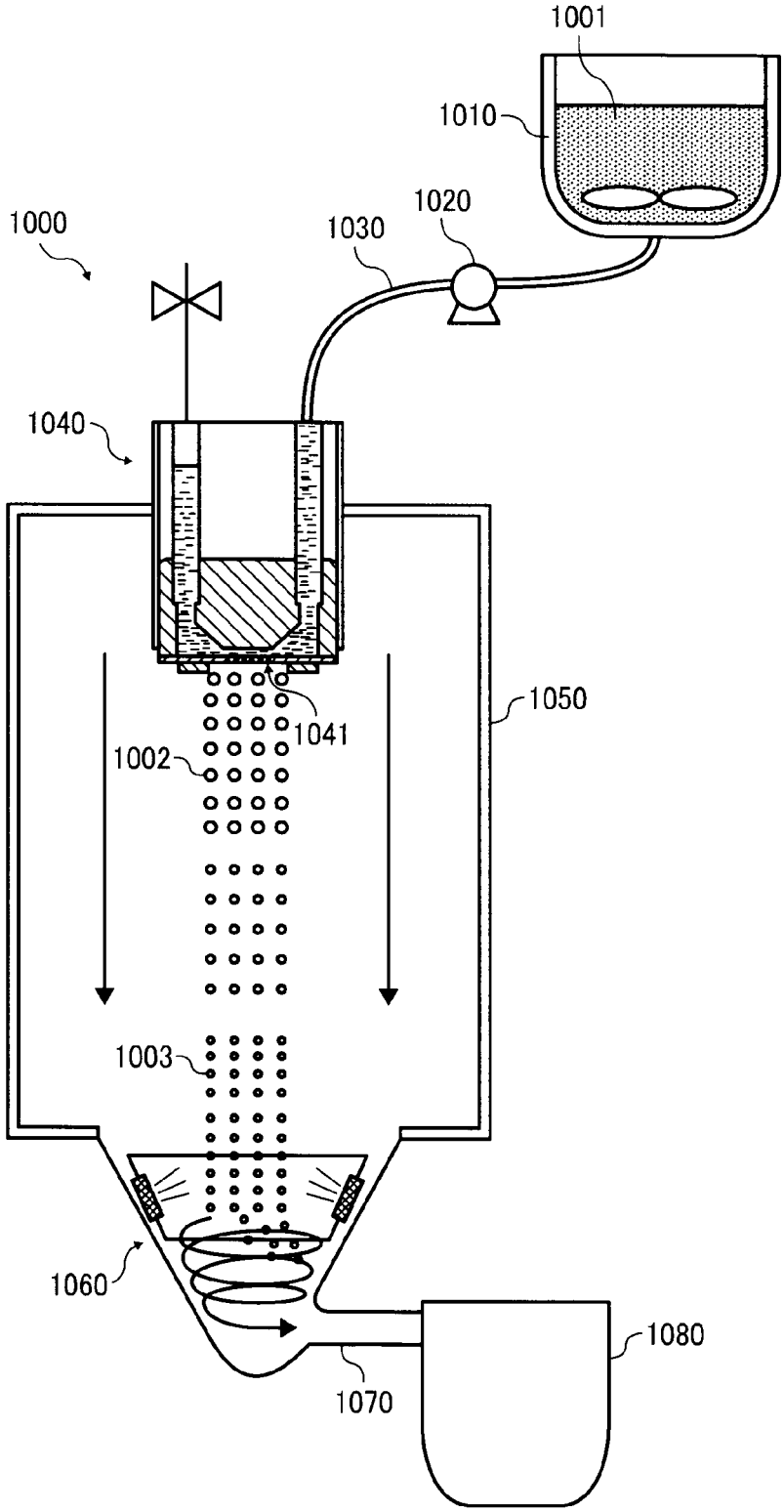
FIG. 7 is a schematic view illustrating a toner producing apparatus having a mechanical vibrator.

FIG. 7 is a schematic view illustrating a toner producing apparatus having a mechanical vibrator. A toner producing apparatus 1000 includes a raw material container 1010 containing a toner composition liquid 1001, a pipe 1030, a pump 1020, a liquid droplet discharging unit 1040, a particle forming member 1050, a toner collector 1060, and a toner storage 1080. The pipe 1030 supplies the toner composition liquid 1001 from the raw material container 1010 to the liquid droplet discharging unit 1040. The pump 1020 pumps the toner composition liquid 1001. The liquid droplet discharging unit 1040 forms liquid droplets 1002 of the toner composition liquid 1001. The particle forming member 1050 solidifies the liquid droplets 1002 into toner particles 1003. The toner collector 1060 collects the toner particles 1003. The toner storage 1080 stores the toner particles 1003 fed from the toner collector 1060 through a tube 1070.

The toner composition liquid 1001 is self-supplied from the raw material container 1010 to the liquid droplet discharging unit 1040 while the liquid droplet discharging unit 1040 is forming liquid droplets, with our without an auxiliary operation of the pump 1020. The toner composition liquid 1001 is a solution or dispersion in which the toner composition is dissolved or dispersed in a solvent.

Figure 8:
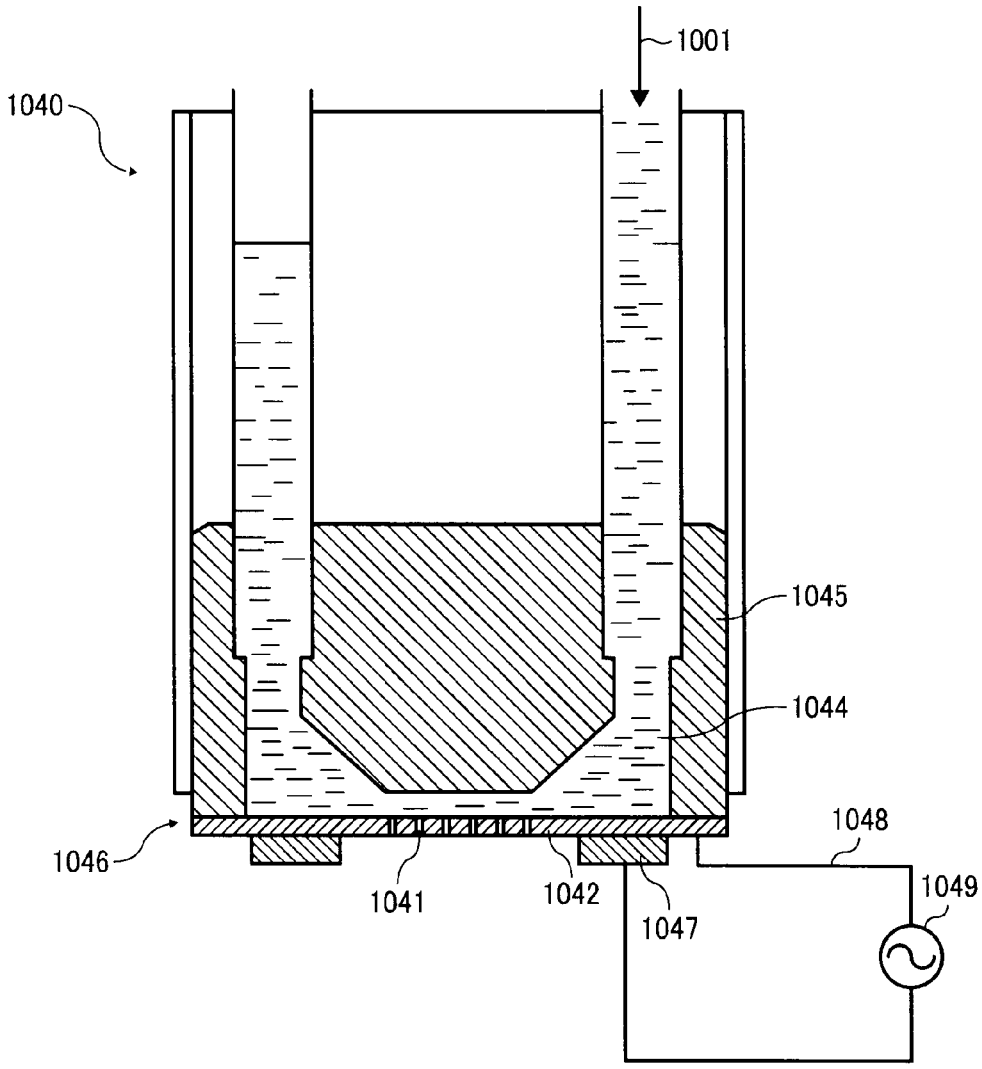
FIG. 8 and FIG. 9 are cross-sectional and bottom views, respectively, illustrating a liquid droplet discharging unit included in the toner producing apparatus.
Figure 9:
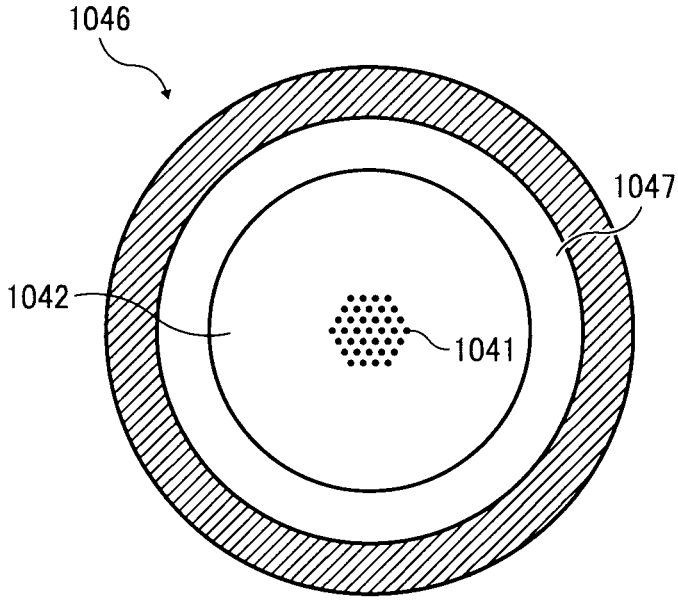
Figure 10:
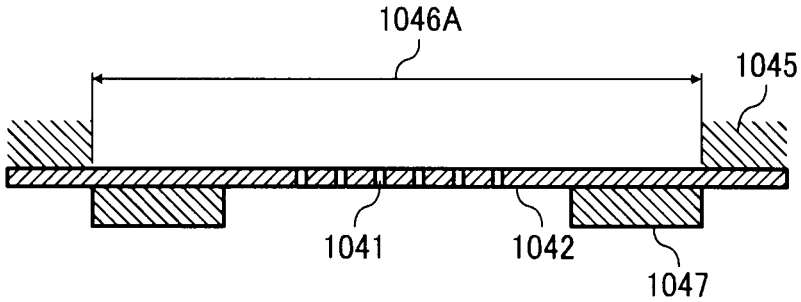
FIG. 10 is a magnified cross-sectional view illustrating a liquid droplet forming member in the liquid droplet discharging unit.
Figure 11A:
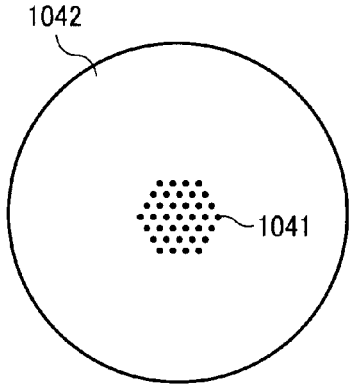
FIGS. 11A and 11B are schematic views illustrating a thin film in the liquid droplet discharging unit.
Figure 11B:
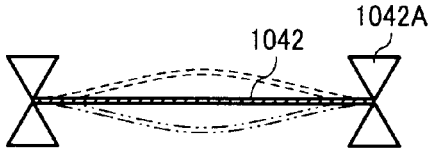
Figure 12:
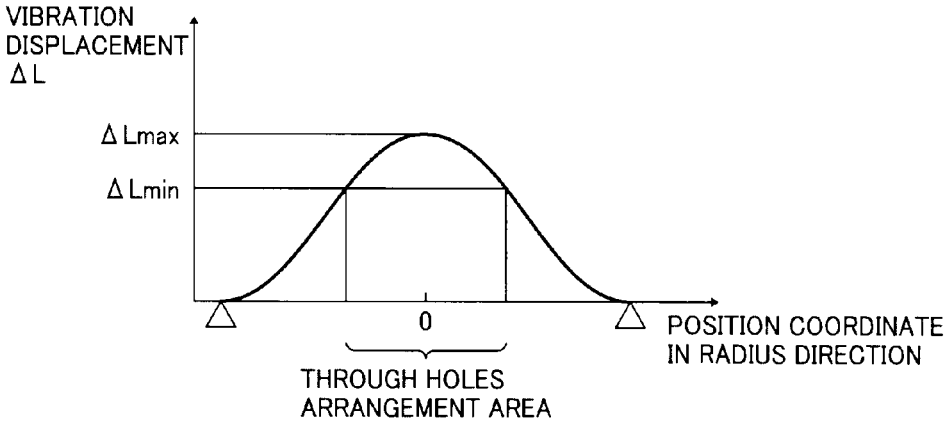
FIG. 12 is an explanatory chart for a fundamental vibrational mode.

Details of the ring-type liquid droplet discharging unit 1040 are described below with reference to FIG. 8 to FIG. 12. FIG. 8 and FIG. 9 are cross-sectional and bottom views, respectively, illustrating the liquid droplet discharging unit 1040. FIG. 10 is a magnified cross-sectional view illustrating a liquid droplet forming member in the liquid droplet discharging unit 1040. FIGS. 11A and 11B are schematic views illustrating a thin film in the liquid droplet discharging unit 1040. FIG. 12 is an explanatory chart for a fundamental vibrational mode. The liquid droplet discharging unit 1040 includes a liquid droplet forming unit 1046 that forms liquid droplets of the toner composition liquid 1001 and a path forming member 1045 forming a liquid path 1044 that supplies the toner composition liquid 1001.

The liquid droplet forming unit 1046 includes a thin film 1042 having multiple through holes 1041 and a circular vibration generator (electromechanical converter) 1047 that vibrates the thin film 1042. The outermost peripheral area of the thin film 1042, shown by a shaded area in FIG. 9, and the path forming member 1045 are fixedly bonded with solder or a resin insoluble in the toner composition liquid 1001. The circular vibration generator 1047 is circularly disposed around a deformable area 1046A, which is not fixed to the path forming member 1045, on the thin film 1042. The circular vibration generator 1047 generates flexural vibration when supplied with a driving voltage (driving signal) having a predetermined frequency from a driving circuit (driving signal generator) 1049 through a lead wire 1048.

In the liquid droplet forming unit 1046, the circular vibration generator 1047 is disposed around the deformable area 1046A of the thin film 1042 having the multiple through holes 1041 facing the liquid path 1044. Such a configuration makes the amount of displacement of the thin film 1042 relatively large. Thus, the multiple through holes 1041 are disposed on a relatively large area (having a diameter of 1 mm or more) on the thin film 1042 which can be displaced greatly. As a result, a large amount of liquid droplets 1002 can be reliably formed simultaneously.

Although the toner producing apparatus illustrated in FIG. 7 includes only one liquid droplet discharging unit 1040, it is more preferable that two or more, preferably 100 to 1,000, liquid droplet discharging units 1040 are arranged on an upper surface of the particle forming member 1050 in terms of controllability. In this case, each liquid droplet discharging unit 1040 is connected to the raw material container 1010 by respective pipe 1030. With such a configuration, a larger amount of liquid droplets 1002 can be reliably formed simultaneously, resulting in improvement of production efficiency.

A mechanism of liquid droplet formation in the liquid droplet discharging unit 1040 is described in detail below. As described above, in the liquid droplet discharging unit 1040, a vibration generated from the circular vibration generator 1047 is transmitted to the thin film 1042 so that the thin film 1042 is periodically vibrated. The thin film 1042 has the multiple through holes 1041 facing the liquid path 1044 on a relatively large area (having a diameter of 1 mm or more), and the liquid droplets 1002 are reliably discharged from the through holes 1041 by the periodical vibration of the thin film 1042.

Referring to FIGS. 11A and 11B, when a periphery 1042A of the thin film 1042, having a simple circular shape, is fixed, the periphery becomes a node of the fundamental vibration. More specifically, a cross-sectional wave shape of the fundamental vibration has the maximum displacement ΔLmax at the center O of the thin film 1042.

Upon vibration of the thin film 1042, a sound pressure Pac is generated in the toner composition liquid in the vicinity of each of the through holes 1041 disposed on the thin film 1042. The sound pressure Pac is proportional to a vibration velocity Vm of the thin film 1042. It is known that the sound pressure Pac is generated as a counteract of a radiation impedance Zr of a medium (i.e., the toner composition liquid), and is represented by the following formula (4):

$$Pac(r,t)=Zr\cdot Vm(r,t) \quad (4)$$

The vibration velocity Vm periodically varies with time. Thus, the vibration velocity Vm is a function of time (t) which can form a periodical variation such as a sine wave and a rectangular wave. The vibration displacement of the thin film 1042 differs by location. Therefore, the vibration velocity Vm is also a function of position coordinate on the thin film 1042. Since the thin film 1042 vibrates axisymmetrically, the vibration velocity Vm is substantially a function of a radius coordinate (r).

In summary, a sound pressure is generated in proportional to a distributed vibration velocity of the thin film 1042, and the toner composition liquid 1001 is discharged to a gaseous phase according to a periodical variation of the sound pressure. The toner composition liquid 1001 periodically discharged to the gaseous phase is formed into spheres by the surface tension difference between the liquid phase and the gaseous phase, resulting in periodical formation of liquid droplets.

To form liquid droplets, the vibration frequency of the thin film 1042 is preferably 20 kHz to 2.0 MHz, and more preferably 50 kHz to 500 kHz. When the vibration frequency is 20 kHz or more, the toner composition liquid is excited so that dispersion of materials, such as a pigment or a wax, is accelerated. When the amount of displacement of the sound pressure is 10 kPa or more, dispersion of such materials is more accelerated.

The diameter of each of the liquid droplets 1002 becomes greater as the vibration displacement of the thin film 1042 in the vicinity of a corresponding through hole 1041 becomes greater. When the vibration displacement is too small, the resulting liquid droplets may be too small or no liquid droplet is formed. To reduce variation in liquid droplet size by location of the through hole on the thin film 1042, the through holes 1041 are arranged on an optimum position in view of vibration displacement.

In the present embodiment, the through holes 1041 are arranged in an area in which the ratio R (=ΔLmax/ΔLmin) of the maximum vibration displacement ΔLmax to the minimum vibration displacement ΔLmin of the thin film 1042 is kept 2.0 or less, as illustrated in FIG. 12. In this case, variation in liquid droplet size is minimized, and therefore the resulting toner particles can provide high quality images.

When the toner composition liquid 1001 has a viscosity of 20 mPa·s or less and a surface tension of 20 to 75 mN/m, satellites are generated. Thus, the amount of displacement of the sound pressure is preferably 500 kPa or less, and more preferably 100 kPa or less. The satellite is a very fine particle, extremely smaller than the toner particles 1003, generated due to instantaneous pressure variation caused by pulsing motion of the toner composition liquid 1001 flowing in the liquid path 1044.

The thin film 1042 discharges the toner composition liquid from the through holes 1041 to form the liquid droplets 1002. There is no limit for the material of the thin film 1042 and the shape of the through holes 1041. To form extremely-uniformly-sized micro liquid droplets, preferably, the thin film 1042 is made of a metallic plate having a thickness of 5 to 500 μm, and each of the through holes 1041 has an opening diameter of 1 to 40 μm, more preferably 3 to 35 μm. The opening diameter is defined as a diameter when the through hole 1041 has a true circle shape, and a short diameter when the through hole 1041 has an oval shape. The number of the through holes 1041 is preferably 2 to 3,000.

The liquid droplets 1002 are discharged to a gaseous phase, such as heated and dried nitrogen gas phase, so that the solvent is removed from the liquid droplets 1002 to dry the liquid droplets 1002. The liquid droplets 1002 may be further subject to a secondary drying, such as fluidized-bed drying or vacuum drying, if needed.

Next, the method in which the toner composition is formed into particles in a liquid phase is described in detail. The method may be, for example, any wet granulation method such as dissolution suspension method. Some exemplary methods, such as emulsion aggregation method, dissolution suspension method, suspension granulation method, suspension polymerization method, ester elongation method, are described in detail below.

An emulsion aggregation method includes the first aggregation step, the second adhesion step, and the third fusion step.

In the first aggregation step, binder resin particles are prepared from an emulsion polymerization of a monomer, and are dispersed in a solvent with an ionic surfactant. Other toner components, such particles of the crystalline polyester resin and/or release agent prepared by a method according to exemplary embodiments, a colorant, etc., are dispersed in a solvent with another ionic surfactant having the opposite polarity. These dispersions are mixed to cause hetero aggregation. Thus, aggregated particles are formed.

In the second adhesion step, resin particles are optionally added and adhered to the surfaces of the aggregated particles so that a covering layer is formed on the aggregated particles. This process makes the resulting toner have a core-shell structure.

In the third fusion step, the aggregated particles are fused with each other by being heated to a temperature equal to or above the highest glass transition point or melting point among the binder resins. Thereafter, the fused particles are washed and dried to obtain toner particles.

As described above, the second adhesion step is optional. In a case in which the adhesion step is employed, in the first aggregation step, initial amounts of ionic surfactants in respective dispersions are made unbalanced. The ionic surfactants are then ionically neutralized with an inorganic metal salt (e.g., calcium nitrate) or an inorganic metal salt polymer (e.g., polyaluminum chloride) to form and stabilize aggregated particles (i.e., core particles) at or below the glass transition point or melting point of the binder resin. In the adhesion step, additional binder resin particles are added and adhered to the surface of the core particles. The additional binder resin particles have been treated with a specific amount of a dispersant having a specific polarity so that the unbalance among the dispersions is compensated. Optionally, the core particles adhering the additional binder resin particles are slightly heated to a temperature equal to or below the glass transition point of the binder resin or additional binder resin and stabilized at a higher temperature, before being fused with each other by being heated to a temperature equal to or above the glass transition point of the additional binder resin. The adhesion step can be repeated for several times.

A dissolution suspension method includes the steps of dissolving toner components such as particles of the crystalline polyester resin and/or release agent prepared by a method according to exemplary embodiments, a colorant, etc., in an organic solvent (e.g., ethyl acetate); and dispersing the resulting solution in an aqueous medium with an inorganic fine particle (e.g., calcium phosphate) or an organic dispersant (e.g., polyvinyl alcohol, sodium polyacrylate) upon application of mechanical shearing force by a homogenizer such as TK HOMOMIXER.

The resulting dispersion is added to 1M hydrochloric acid aqueous solution so that the dispersants are dissolved and removed, and is further filtered so that solid components and liquid components are separated. Finally, the solvents remaining in the resulting particles are removed. Thus, toner particles are obtained.

A dissolution emulsification method includes the steps of dissolving a binder resin in an organic solvent (e.g., ethyl acetate); emulsifying the resulting solution by mechanical shearing force from a homogenizer such as TK HOMOMIXER and surface activating force of ionic surfactants (e.g., sodium alkylbenzene sulfonate) to form binder resin particles; and removing residual solvent by reduced-pressure distillation, to obtain a dispersion of the binder resin particles. Succeeding steps are the same as the emulsion aggregation method described above.

A suspension granulation method includes the steps of preparing a polymer solution including a prepolymer having a weight average molecular weight (Mw) of 3,000 to 15,000 measured by GPC (gel permeation chromatography); adding toner components such as particles of the crystalline polyester resin and/or release agent prepared by a method according to exemplary embodiments, a colorant, a monomer, and a polymerization initiator, to the polymer solution; suspending the resulting solution upon application of mechanical shearing force in the presence of an inorganic or organic dispersant; and applying thermal energy to the resulting suspension upon application of agitation shearing force to prepare polymer particles.

When the prepolymer has a weight average molecular weight (Mw) of 3,000 to 15,000, the above solutions have a proper viscosity and the resulting toner has a proper fixing property. Additionally, the weight average molecular weight (Mw) of the binder resin included in the resultant toner is controllable without chain transfer agent.

A suspension polymerization method includes the steps of agitating a polymerizable mixture including particles of the crystalline polyester resin and/or release agent prepared by a method according to exemplary embodiments, a monomer, a polymerization initiator, a colorant, etc., in an aqueous medium containing a suspension stabilizer, to prepare polymer particles. More preferably, the suspension polymerization method includes the steps of agitating a polymerizable mixture including particles of the crystalline polyester resin and/or release agent prepared by a method according to exemplary embodiments, a monomer, a polymerization initiator, a colorant, and a cationic polymer, in an aqueous medium containing an anionic dispersant, to prepare polymer particles. The resulting toner has a configuration such that the release agent is encapsulated in the suspending particle. Thus, this toner has improved fixability and offset resistance.

An ester elongation method includes the steps of preparing an oil phase by dispersing toner components such as particles of the crystalline polyester resin and/or release agent prepared by a method according to exemplary embodiments, a binder resin, and a colorant, in a solvent; preparing an aqueous phase by dispersing a particle diameter controlling agent and a surfactant in water; and emulsifying the oil phase in the aqueous phase. Thus, oil droplets each containing the toner components are formed. The oil droplets are properly converged so that the particle size distribution is more narrowed. The binder resin is elongated in the process of emulsification so that a high-molecular-weight binder resin is formed in the oil droplets. Succeeding steps are the same as the dissolution suspension method described above.

The toner according to exemplary embodiments is not limited in its properties, such as shape and size. Preferably, the toner has the following properties in terms of image density, average circularity, weight average particle diameter, and number average particle diameter.

An image produced with the toner preferably has an image density of 1.90 or more, more preferably 2.00 or more, and most preferably 2.10 or more, measured by a spectrophotometer (938 SPECTRO DENSITOMETER from X-Rite). High resolution image may not be provided when the image density is too low. Here, the image density is defined as the average of image density values measured with the spectrophotometer at 6 randomly-selected positions on a solid image having 1.00±0.05 mg/cm$^2$ of the toner fixed at 160±2° C. on a copier paper TYPE 6000 <70 W> (from Ricoh Co., Ltd.) by an image forming apparatus IMAGIO NEO 450 (from Ricoh Co., Ltd.).

The toner preferably has an average circularity of 0.900 to 0.980, more preferably 0.950 to 0.975. The circularity is defined as a ratio of a circumferential length of a circle having the same area as a projected image of a toner particle to a circumferential length of the projected image of the toner particle. More preferably, the toner includes particles having a circularity less than 0.94 in an amount of 15% or less. When the average circularity is too small, the toner may not have sufficient transferability and may not produce high-resolution image without toner scattering. When the average circularity is too large, such toner particles may not be sufficiently removed from a photoreceptor or a transfer belt in image forming systems employing a blade cleaning member. For example, when toner particles remain on a photoreceptor without being transferred onto paper due to the occurrence of paper jam, especially in forming an image having a high image area ratio such as a photographic image, such residual toner particles may undesirably retransferred onto background portions of a next image. Alternatively, such residual toner particles may contaminate and deteriorate a charging roller that charges the photoreceptor.

The average circularity can be measured with a flow type particle image analyzer FPIA-2000 from Sysmex Corporation as follows, for example. First, water is subjected to filtration to remove fine foreign substances such that the water contains particles having a circle-equivalent diameter which falls within the measuring range (e.g., 0.60 to 159.21 μm) in a number only 20 or less per $10^{-3}$ cm$^3$. Next, several drops of a nonionic surfactant (preferably CONTAMINON N from Wako Pure Chemical Industries, Ltd.) are added to 10 ml of the above-prepared water. After further adding 5 mg of a sample, the resulting liquid is subjected to a dispersion treatment for 1 minute using an ultrasonic disperser (UH-50 from STM) at 20 kHz and 50 W/10 $cm^3$. The liquid is subjected to this dispersion treatment for 5 minutes in total. The resulting sample dispersion contains 4,000 to 8,000 particles per $10^{-3}$ $cm^3$, the particles having a circle-equivalent diameter which falls within the measuring range of not less than 0.60 μm and less than 159.21 μm.

The sample dispersion is passed through a flow path of a flat transparent flow cell having a thickness of about 200 μm. A stroboscopic lamp and a CCD camera are respectively provided on opposite sides of the flow cell so that an optical path is formed crossing the thickness direction of the flow cell. While the sample dispersion is flowing, the stroboscopic lamp emits light at an interval of 1/30 seconds to obtain a two-dimensional image of the particles flowing in the flow cell. The image is parallel to a part of the flow cell. Circle-equivalent diameter of each particle is calculated as a circle having the same area as the two-dimensional image of the particle.

More than 1,200 particles can be subjected to the measurement of circle-equivalent diameter in about 1 minute. Thus, a number distribution and a ratio (% by number) of particles having a specific circle-equivalent diameter can be determined. In the resulting frequency and cumulative distributions (%), a range of 0.06 to 400 μm is divided into 26 channels (i.e., 1 octave is divided into 30 channels). The actual measuring range is not less than 0.60 μm and less than 159.21 μm.

The toner preferably has a number average particle diameter of 3 to 10 μm, and more preferably 3 to 8 μm. When the number average particle diameter is too small, such toner particles may undesirably fuse on the surfaces of carrier particles and degrade charging ability of the carrier particles after a long-term agitation in a developing device, when used for a two-component developer. Such toner particles may also fuse on a developing roller or a toner layer regulator, when used for a one-component developer. When the number average particle diameter is too large, such toner particles may be difficult to produce high-resolution and high-quality images. Moreover, the average particle diameter may largely vary upon consumption and supply of such toner particles used for a developer.

The ratio of the weight average particle diameter to the number average particle diameter is preferably 1.00 to 1.25, more preferably 1.00 to 1.10. When the ratio of the weight average particle diameter to the number average particle diameter is too large, such toner particles may undesirably fuse on the surfaces of carrier particles and degrade charging ability of the carrier particles after a long-term agitation in a developing device, when used for a two-component developer. When the ratio of the weight average particle diameter to the number average particle diameter is too large, such toner particles may fuse on a developing roller or a toner layer regulator, when used for a one-component developer. Such toner particles may be difficult to produce high-resolution and high-quality images. Moreover, the average particle diameter may largely vary upon consumption and supply of such toner particles used for a developer.

The number average particle diameter and the weight average particle diameter can be measured using a particle size analyzer COULTER COUNTER TA II (from Beckman Coulter), for example.

A developer according to exemplary embodiments includes the toner according to exemplary embodiments. The developer may be either a magnetic or non-magnetic one-component developer consisting of the toner or a two-component developer consisting of the toner and a magnetic carrier. The two-component developer preferably includes 100 parts by weight of a magnetic carrier and 1 to 10 parts by weight of the toner.

The carrier preferably comprises a magnetic core material and a resin layer that covers the core material. Specific preferred materials suitable for the magnetic core material include, but are not limited to, iron powder, ferrite powder, magnetite powder, and magnetic resin carrier, having a particle diameter of 20 to 200 μm. Specific preferred examples of suitable covering materials for the resin layer include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate, polybutylene terephthalate), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins.

The covering material may contain a conductive powder therein. Specific preferred materials of suitable conductive powders include, but are not limited to, a metal, carbon black, titanium oxide, tin oxide, and zinc oxide. The conductive powder preferably has an average particle diameter of 1 μm or less. When the average particle diameter is too large, it may be difficult to control electric resistivity of the resin layer. The resin layer can be formed by, for example, dissolving a covering material in a solvent to prepare a coating liquid, and uniformly coating the coating liquid on the surface of the core material, followed by drying and baking. The carrier preferably includes the resin layer in an amount of 0.01 to 5.0% by weight. When the amount of the resin layer is too small, it means that the resin layer cannot be uniformly formed on the core material. When the amount of the resin layer is too large, it means that the resin layer is so thick the each carrier particles are fused with each other.

The developer according to exemplary embodiments may be used for any electrophotographic image forming method, such as magnetic one-component developing methods, non-magnetic one-component developing methods, and two-component developing methods. The developer according to exemplary embodiments has excellent chargeability and reliably provides high-quality images because of including the toner according to exemplary embodiments.

A process cartridge according to exemplary embodiments includes at least an electrostatic latent image bearing member that bears an electrostatic latent image and a developing device that develops the electrostatic latent image with the toner according to exemplary embodiments into a toner image.

The process cartridge is conveniently detachably attachable to image forming apparatuses. The developing device includes a developer container that contains the developer according to exemplary embodiments and a developer bearing member that bears and conveys the developer in the developer container. The developing device may further include a toner layer regulator that regulates the thickness of a toner layer on the developer bearing member.

Figure 13:
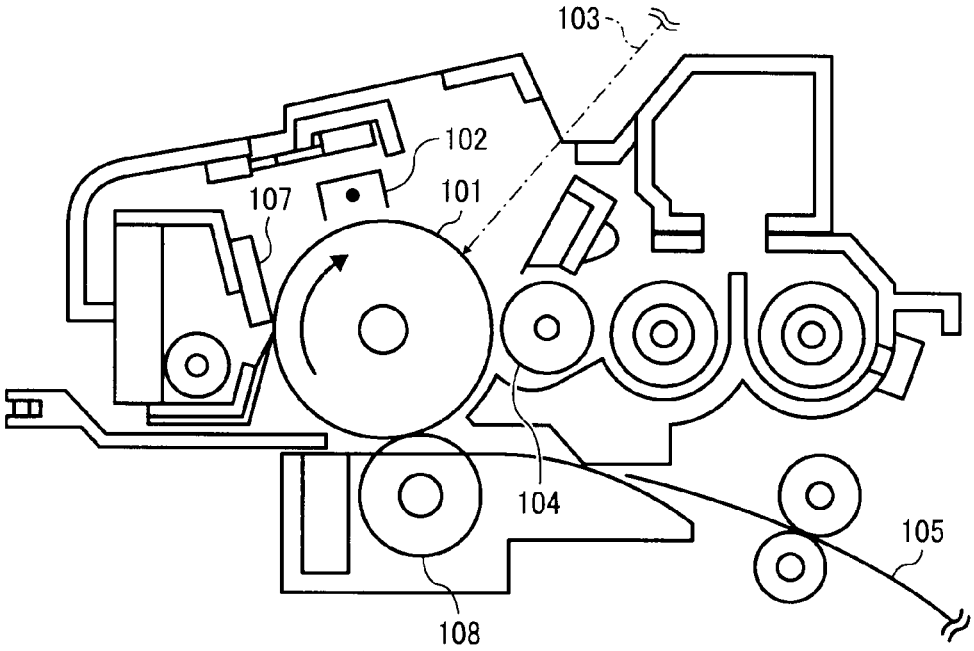
FIG. 13 is a schematic view illustrating a process cartridge according to exemplary embodiments.

FIG. 13 is a schematic view illustrating a process cartridge according to exemplary embodiments. The process cartridge includes an electrostatic latent image bearing member 101, a charger 102, a developing device 104, a transfer device 108, and a cleaner 107. A numeral 103 denotes a light beam emitted from an irradiator and a numeral 105 denotes a recording medium.

The process cartridge forms images in the following procedures. The electrostatic latent image bearing member 101 is charged by the charger 102 and then exposed to the light beam 103 emitted from the irradiator while rotating clockwise in FIG. 13. As a result, an electrostatic latent image is formed on the electrostatic latent image bearing member 101. The developing device 104 develops the electrostatic latent image into a toner image. The transfer device 108 transfers the toner image onto the recording medium 105. The cleaner 107 cleans the surface of the electrostatic latent image bearing member 101 after the toner image has been transferred therefrom and a neutralizer further neutralizes the surface. The above-described procedures are repeated.

An image forming method according to exemplary embodiments of the invention include an electrostatic latent image forming process, a developing process, a transfer process, and a fixing process. The image forming method may optionally include other processes, such as a neutralization process, a cleaning process, a recycle process, and a control process, if needed.

An image forming apparatus according to exemplary embodiments of the invention include an electrostatic latent image bearing member, a developing device, a transfer device, and a fixing device. The image forming apparatus may optionally include other members, such as a neutralizer, a cleaner, a recycler, and a controller, if needed.

The electrostatic latent image forming process is a process which forms an electrostatic latent image on an electrostatic latent image bearing member. There is not a limit on material, shape, structure, or size of the electrostatic latent image bearing member. Preferably, the electrostatic latent image bearing member has a drum-like shape and is comprised of an inorganic photoconductor, such as amorphous silicone and selenium, or an organic photoconductor, such as polysilane and phthalopolymethyne. Amorphous silicone is most preferable in terms of long lifespan.

In the electrostatic latent image forming process, for example, an electrostatic latent image forming device uniformly charges a surface of the electrostatic latent image bearing member and irradiates the charged surface with light containing image information. The electrostatic latent image forming device comprises, for example, a charger that uniformly charges a surface of the electrostatic latent image bearing member and an irradiator that irradiates the charged surface with light containing image information.

The charger uniformly charges a surface of the electrostatic latent image bearing member by supplying a voltage thereto. The charger may be, for example, a contact charger equipped with a conductive or semiconductive roll, brush, film, or rubber blade, or a non-contact charger such as corotron and scorotron that use corona discharge.

The irradiator irradiates the charged surface of the electrostatic latent image bearing member with light containing image information. The irradiator may be, for example, a radiation optical type, a rod lens array type, a laser optical type, or a liquid crystal shutter optical type. The electrostatic latent image bearing member may be irradiated with light from the reverse surface (back surface) side thereof.

The developing process is a process which develops the electrostatic latent image into a toner image that is visible with the toner or developer according to exemplary embodiments of the invention. In particular, the developing device develops the electrostatic latent image into a toner image with the toner or developer according to exemplary embodiments of the invention.

The developing device preferably includes a container that contains the toner or developer according to exemplary embodiments and a developing unit that supplies the toner or developer to the electrostatic latent image with or without contacting the electrostatic latent image.

The developing device may employ either a dry developing method or a wet developing method. The developing device may be either a single-color developing device or a multi-color developing device. The developing device is preferably comprised of an agitator that frictionally agitates and charges the toner or developer, and a rotatable magnet roller.

In the developing device, toner particles and carrier particles are mixed and agitated so that the toner particles are frictionally charged. The charged toner particles and carrier particles are borne on the surface of the magnet roller forming chainlike aggregations (hereinafter "magnetic brush"). The magnet roller is disposed adjacent to the electrostatic latent image bearing member. Therefore, a part of the toner particles in the magnetic brush migrates from the surface of the magnet roller to the surface of the electrostatic latent image bearing member due to electrical attractive force. As a result, an electrostatic latent image formed on the electrostatic latent image bearing member is developed into a toner image.

The developing device stores the developer according to exemplary embodiments. The developer may be either a one-component developer or a two-component developer.

The transfer process is a process which transfers the toner image from the electrostatic latent image bearing member onto a recording medium. Preferably, the toner image is primarily transferred from the electrostatic latent image bearing member onto an intermediate transfer medium, and secondarily transferred from the intermediate transfer medium onto the recording medium. More preferably, multiple toner images with different colors are primarily transferred from the electrostatic latent image bearing members onto the intermediate transfer medium to form a composite toner image, and the composite toner image is secondarily transferred from the intermediate transfer medium onto the recording medium.

In particular, the transfer device transfers a toner image from the electrostatic latent image bearing member by charging the electrostatic latent image bearing member. The transfer device preferably includes a primary transfer device that transfers toner images from electrostatic latent image bearing members onto an intermediate transfer medium to form a composite toner image, and a secondary transfer device that transfers the composite toner image from the intermediate transfer medium onto a recording medium. The intermediate transfer medium may be, for example, a transfer belt.

The transfer device (including the primary transfer device and the secondary transfer device) contains a transfer unit that separates a toner image from the electrostatic latent image bearing member toward a recording medium side. The number of the transfer device may be one or more. The transfer unit may be, for example, a corona discharger, a transfer belt, a transfer roller, a pressure transfer roller, or an adhesive transfer unit.

The recording medium is not limited to a specific material, and any kind of material can be used as the recording medium.

The fixing process is a process in which the fixing device fixes the toner image on a recording medium. Each single-color toner image may be independently fixed on a recording medium. Alternatively, a composite toner image including multiple color toner images may be fixed on a recording medium at once. The fixing device preferably includes a heating member and a pressing member. For example, the fixing device may include a combination of a heating roller and a pressing roller, or a combination of a heating roller, a pressing roller, and an endless belt. The heating member preferably heats the toner image to a temperature of 80 to 200° C. In the fixing process, an optical fixer can be used in place of or in combination with the fixing device.

The neutralization process is a process in which the neutralizer neutralizes the electrostatic latent image bearing member by supplying a neutralization bias thereto. The neutralizer may be, for example, a neutralization lamp.

The cleaning process is a process in which the cleaner removes residual toner particles remaining on the electrostatic latent image bearing member. The cleaner may be, for example, a magnetic brush cleaner, an electrostatic brush cleaner, a magnetic roller cleaner, a blade cleaner, a brush cleaner, or a web cleaner.

The recycle process is a process in which the recycler supplies the residual toner particles collected in the cleaning process to the developing device. The recycler may be, for example, a conveyer.

The control process is a process in which the controller controls the above-described processes. The controller may be, for example, a sequencer or a computer.

Exemplary embodiments of the invention are not limited to the particle producing apparatus 1 illustrated in FIG. 4, and include any typical apparatus employing the PGSS (Particles from Gas Saturated Solution) method.

A method of forming liquid droplets is not limited to the above-described method in which the thin film 1042 having the through holes 1041 is vibrated by the mechanical vibrator so that the toner composition liquid 1001 is discharged from the through holes 1041 to a gaseous phase. For example, the toner composition liquid may be sprayed from through holes by application of pressure, or may be sprayed by mixing with a compressed air. Alternatively, the toner composition liquid may be formed into liquid droplets by centrifugal force using a rotatable disc.

The mechanical vibrator is not limited to the above-described ring-type mechanical vibrator, and may be a horn-type mechanical vibrator as illustrated in Japanese Patent Application Publication No. 2009-116049, the disclosures thereof being incorporated herein by reference.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Crystalline Polyester Resins

Crystalline Polyester Resin Example 1

A 5-liter four-necked flask equipped with a nitrogen inlet pipe, a dewatering pipe, a stirrer, and a thermocouple is charged with 25 mol of 1,4-butanediol, 23.75 mol of fumaric acid, 1.65 mol of trimellitic anhydride, and 5.3 g of hydroquinone. The mixture is subjected to reaction for 5 hours at 160° C., subsequent 1 hour at 200° C., and further 1 hour at 8.3 kPa. Thus, a crystalline polyester resin 1 is prepared. The number average molecular weight (Mn), weight average molecular weight (Mw), acid value, and hydroxyl value of the crystalline polyester resin 1 are shown in Table 1. These properties are measured by the following procedures.

Measurement of Acid Value

The acid value is represented by the amount (mg) of potassium hydroxide needed for neutralizing an acid included in 1 g of a sample, and is measured as follows.

(1) Preparation of Reagents

A phenolphthalein solution is prepared by dissolving 1.0 g of phenolphthalein in 90 ml of ethyl alcohol (95% by volume) and further adding ion-exchange water thereto so that the resulting solution has a volume of 100 ml. A potassium hydroxide solution is prepared by dissolving 7 g of special grade potassium hydroxide in 5 ml of water and further adding ethyl alcohol (95% by volume) thereto so that the resulting solution has a volume of 1 liter, and leaving the solution for 3 days in an alkali-resistant container, followed by filtering. The resulting potassium hydroxide solution is stored in an alkali-resistant container. The factor of the potassium hydroxide solution is determined from its amount needed for neutralizing 25 ml of a 0.1 mol/l hydrochloric acid in a conical flask to which several drops of the phenolphthalein solution have been added. The 0.1 mol/l hydrochloric acid is prepared based on a method according to JIS K 8001-1998.

(2) Measuring Operations (A) Main test: A pulverized sample (e.g., a crystalline polyester resin) in an amount of 2.0 g is precisely weighed in a 200-ml conical flask, and dissolved in 100 ml of a mixed solvent of diethyl ether and ethanol (99.5), the mixing ratio of which is 1:1 or 2:1 by volume, over a period of 5 hours. After adding several drops of the phenolphthalein solution as an indicator, the above-prepared liquid is titrated with the potassium hydroxide solution. The termination of the titration is indicated by pale pink color of the indicator lasting for about 30 seconds.

(B) Blank test: The procedure in the main test is repeated except that no sample is dissolved in the mixed solvent.

(3) The acid value is calculated from the following equation:

$$A=[(C-B)\times f\times 5.61]/S$$

wherein A represents an acid value (mgKOH/g), B represents an added amount (ml) of the potassium hydroxide solution in the blank test, C represents an added amount (ml) of the potassium hydroxide solution in the main test, and S represents a weight (g) of the sample.

Measurement of Hydroxyl Value

The hydroxyl value is represented by the amount (mg) of potassium hydroxide needed for neutralizing acetic acid bonded with hydroxyl groups when acetylating 1 g of a sample, and is measured as follows.

(1) Preparation of Reagents

An acetylating reagent is prepared by mixing 25 g of special grade acetic anhydride with pyridine in a 100-ml measuring flask so that the resulting liquid has a volume of 100 ml by sufficient shaking. The resulting acetylating reagent is stored in a brown bottle so as not to be exposed to moisture or carbon dioxide gas. A phenolphthalein solution is prepared by dissolving 1.0 g of phenolphthalein in 90 ml of ethyl alcohol (95% by volume) and further adding ion-exchange water thereto so that the resulting solution has a volume of 100 ml. A potassium hydroxide solution is prepared by dissolving 35 g of special grade potassium hydroxide in 20 ml of water and further adding ethyl alcohol (95% by volume) thereto so that the resulting solution has a volume of 1 liter, and leaving the solution for 3 days in an alkali-resistant container, followed by filtering. The resulting potassium hydroxide solution is stored in an alkali-resistant container. The factor of the potassium hydroxide solution is determined from its amount needed for neutralizing 25 ml of a 0.5 mol/l hydrochloric acid in a conical flask to which several drops of the phenolphthalein solution have been added. The 0.5 mol/l hydrochloric acid is prepared based on a method according to JIS K 8001-1998.

(2) Measuring Operations (A) Main test: A pulverized sample (e.g., a crystalline polyester resin) in an amount of 1.0 g is precisely weighed in a 200-ml round-bottom flask and further 5.0 ml of the acetylating reagent are precisely added thereto with a volumetric pipette. When the sample is poorly soluble in the acetylating reagent, a small amount of special grade toluene is added. The flask is dipped in a glycerin bath at about 97° C. for about 1 cm from its bottom while putting a small funnel on the mouth of the flask. To prevent undesirable temperature increase at the neck of the flask due to the heat from the bath, the base of the neck of the flask is preferably covered with a thick paper having a rounded hole. The flask is taken out of the glycerin bath after 1-hour dipping, followed by cooling. After adding 1 ml of water from the funnel, the liquid in the flask is shaken so that acetic anhydride is hydrolyzed. To complete the hydrolysis, the flask is reheated in the glycerin bath for 10 minutes. After cooling the flask, the funnel and the walls of the flask are washed with 5 ml of ethyl alcohol. After adding several drops of the phenolphthalein solution as an indicator, the above-prepared liquid is titrated with the potassium hydroxide solution. The termination of the titration is indicated by pale pink color of the indicator lasting for about 30 seconds.

(B) Blank test: The procedure in the main test is repeated except that no sample is added.

(3) The hydroxyl value is calculated from the following equation:

$$A=[\{(B-C)\times 28.05\times f\}/S]+D$$

wherein A represents a hydroxyl value (mgKOH/g), B represents an added amount (ml) of the potassium hydroxide solution in the blank test, C represents an added amount (ml) of the potassium hydroxide solution in the main test, S represents a weight (g) of the sample, and D represents an acid value (mgKOH/g) of the sample.

Measurement of Molecular Weights Mn and Mw

Instrument: GPC (from Tosoh Corporation)

Detector: RI

Measuring temperature: 40° C.

Mobile phase: Tetrahydrofuran

Flow rate: 0.45 mL/min

Number average molecular weight (Mn), weight average molecular weight (Mw), and molecular weight distribution (Mw/Mn) are determined from a chromatogram measured by GPC (gel permeation chromatography) referring to a calibration curve complied from polystyrene standard samples having a known molecular weight.

Measurement of Melting Point

Instrument: DSC (Q2000 from TA Instruments)

A simple sealed aluminum pan filled with 5 to 10 mg of an analyte (e.g., a crystalline polyester resin) is firstly heated from 30° C. to 220° C. at a heating rate of 5° C./min and kept at 220° C. for 1 minute; quenched to −20° C. without temperature control and kept at −20° C. for 1 minute; and secondly heated from −20° C. to 180° C. at a heating rate of 5° C./min. The maximum endothermic peak existing within a temperature range of −20° C. to 180° C. in the DSC curve obtained in the second heating is regarded as the melting point of the analyte (e.g., a crystalline polyester resin).

Crystalline Polyester Resin Example 2

The procedure in Crystalline Polyester Resin Example 1 is repeated except for replacing the raw materials with 25 mol of 1,4-butanediol, 21.25 mol of fumaric acid, 5 mol of trimellitic anhydride, and 5.7 g of hydroquinone. Thus, a crystalline polyester resin 2 is prepared.

Crystalline Polyester Resin Example 3

The procedure in Crystalline Polyester Resin Example 1 is repeated except for replacing the raw materials with 23.75 mol of 1,4-butanediol, 1.25 mol of ethylene glycol, 22.75 mol of fumaric acid, 1.65 mol of trimellitic anhydride, and 4.8 g of hydroquinone. Thus, a crystalline polyester resin 3 is prepared.

Crystalline Polyester Resin Example 4

The procedure in Crystalline Polyester Resin Example 1 is repeated except for replacing the raw materials with 22.5 mol of 1,4-butanediol, 5 mol of ethylene glycol, 23.75 mol of fumaric acid, 5 mol of trimellitic anhydride, and 5.8 g of hydroquinone. Thus, a crystalline polyester resin 4 is prepared.

Crystalline Polyester Resin Example 5

The procedure in Crystalline Polyester Resin Example 1 is repeated except for replacing the raw materials with 25 mol of 1,4-butanediol, 22.5 mol of fumaric acid, 1.25 mol of succinic acid, 1.65 mol of trimellitic anhydride, and 5.3 g of hydroquinone. Thus, a crystalline polyester resin 5 is prepared.

Crystalline Polyester Resin Example 6

The procedure in Crystalline Polyester Resin Example 1 is repeated except for replacing the raw materials with 23.75 mol of 1,4-butanediol, 1.25 mol of 1,6-hexanediol, 23 mol of fumaric acid, 0.75 mol of maleic acid, 1.65 mol of trimellitic anhydride, and 5.2 g of hydroquinone. Thus, a crystalline polyester resin 6 is prepared.

Crystalline Polyester Resin Example 7

The procedure in Crystalline Polyester Resin Example 1 is repeated except for replacing the raw materials with 25 mol of 1,4-butanediol, 23.75 mol of sebacic acid, 1.65 mol of trimellitic anhydride, and 5.3 g of hydroquinone. Thus, a crystalline polyester resin 7 is prepared.

The number average molecular weight (Mn), weight average molecular weight (Mw), acid value, and hydroxyl value of the crystalline polyester resins 2 to 7 are shown in Table 1.

TABLE 1

| Crystalline Polyester Resin No. | Melting Point (° C.) | Number Average Molecular weight (Mn) | Weight Average Molecular weight (Mw) | Acid Value (mg/KOHg) | Hydroxyl Value (mg/KOHg) |
|---|---|---|---|---|---|
| 1 | 119 | 710 | 2,100 | 24 | 28 |
| 2 | 96 | 620 | 1,750 | 37 | 8 |
| 3 | 128 | 1,650 | 6,400 | 24 | 44 |
| 4 | 82 | 1,100 | 4,700 | 25 | 33 |
| 5 | 113 | 780 | 2,400 | 22 | 28 |
| 6 | 128 | 850 | 3,450 | 28 | 22 |
| 7 | 113 | 900 | 2,500 | 23 | 29 |

Preparation of Crystalline Polyester Resin Dispersions

Crystalline Polyester Resin Dispersion Example 1

The crystalline polyester resin 1 is contained in the high pressure cell 14 in the particle producing apparatus 1 illustrated in FIG. 4 and FIG. 5, and mixed with carbon dioxide having a temperature of 60° C. and a pressure of 40 MPa as a supercritical fluid over a period of 1 hour. The resulting melt has a viscosity of 3 mPa·s. The viscosity of the melt is measured by a viscometer VISCOlab PVT (from Cambridge Viscosity, Inc.). The viscometer controls temperature and pressure of the sample to determine the viscosity at which the temperature and pressure become constant. The carbon dioxide is then introduced into the space defined by the particle forming member 331 in the discharger 31 by opening the valve 23 while keeping its temperature of 60° C. and pressure of 40 MPa by the actions of the pump 22 and a heater. At the same time, the melt of the crystalline polyester resin 1 is introduced into the storage 311 in the discharger 31 by opening the valve 13*b* and putting the pump 12*b* into operation. Further, a sine wave having an alternating current frequency of 320 KHz is transmitted from the signal generator 320 to the vibrator 312 comprised of a layered PZT to excite the discharger 31, resulting in formation of particles of the melt. After returning to the atmospheric pressure, the particles of the melt are discharged into ethyl acetate. Thus, a crystalline polyester resin dispersion 1 is prepared. It is confirmed by a micro stroboscopic method that the discharged melt is first formed into a columnar melt and the columnar melt is constricted and separated into particles. The through holes 317 in a number of 100 are disposed in a houndstooth pattern on SUS (stainless steel) having a thickness of 50 μm. Each of the through holes 317 has a diameter of 8.0 μm. The high pressure cell 14 is controlled to have a constant temperature of 130° C. and a constant pressure of 65 MPa by the actions of the pump 12*a* and the back pressure valve 15. The pressure difference between in the storage 311 and in the upper part of the particle forming member 331 is adjusted to 80±50 KPa by the action of the open valve 322.

Crystalline Polyester Resin Dispersion Examples 2 to 10

The procedure in Crystalline Polyester Resin Dispersion Example 1 is repeated except that the crystalline polyester resin 1 is replaced with other crystalline polyester resins and the temperature and pressure conditions in the high-pressure cell are changed as shown in Table 2. Thus, crystalline polyester resin dispersions 2 to 10 are prepared.

Crystalline Polyester Resin Dispersion Example 11

The procedure in Crystalline Polyester Resin Dispersion Example 1 is repeated except that the temperature and pressure conditions in the high-pressure cell are changed as shown in Table 2 and the melt is discharged to nitrogen atmosphere in place of ethyl acetate. Thus, particles 11 are prepared. The particles 11 in an amount of 320 g are then dispersed in ethyl acetate. Thus, a crystalline polyester resin dispersion 11 is prepared.

Crystalline Polyester Resin Dispersion Example 12 (Comparative)

A 2-liter metallic vessel is charged with 100 g of the crystalline polyester resin 1, 100 g of pentaerythritol tetrabehenate, and 400 g of ethyl acetate. The mixture is heated to 79° C. to dissolve the crystalline polyester resin 1, followed by cooling in an ice water bath at a cooling rate of 27° C./min. Thus, a coarse crystalline polyester resin dispersion having a volume average particle diameter of 4 μm is prepared. After adding 500 ml of glass beads having a diameter of 3 mm to the vessel, the mixture in the vessel is subjected to a pulverization treatment for 4 hours using a batch-type sand mill apparatus (from Kanpe Hapio Co., Ltd.). Thus, a crystalline polyester resin dispersion 12 having a volume average particle diameter of 0.4 μm is prepared.

Crystalline Polyester Resin Dispersion Example 13 (Comparative)

The procedure in Crystalline Polyester Resin Dispersion Example 12 is repeated except that the crystalline polyester resin 1 is replaced with the crystalline polyester resin 2. Thus, a crystalline polyester resin dispersion 13 is prepared.

The temperature and pressure conditions in the high-pressure cell in the above Crystalline Polyester Resin Dispersion Examples 1 to 11 are shown in the following Table 2.

TABLE 2

| Crystalline Polyester Resin Dispersion No. | Crystalline Polyester Resin No. | Temperature in High-Pressure Cell (° C.) | Pressure in High-Pressure Cell (MPa) | Average Particle Diameter (μm) |
|---|---|---|---|---|
| 1 | 1 | 60 | 40 | 0.3 |
| 2 | 2 | 60 | 40 | 0.4 |
| 3 | 3 | 60 | 40 | 0.5 |
| 4 | 4 | 60 | 40 | 0.4 |
| 5 | 5 | 60 | 40 | 0.2 |
| 6 | 6 | 60 | 40 | 0.2 |
| 7 | 7 | 60 | 40 | 0.5 |
| 8 | 1 | 80 | 40 | 0.5 |
| 9 | 1 | 60 | 20 | 0.3 |
| 10 | 1 | 40 | 40 | 0.4 |
| 11 | 1 | 40 | 40 | 0.7 |
| 12 (Comparative) | 1 | — | — | 0.4 |
| 13 (Comparative) | 2 | — | — | 0.4 |

Preparation of Toners and Developers

Toner Example 1

Preparation of Amorphous Polyester Resin Dispersion

A heat-dried two-necked flask is charged with 74 parts of dimethyl adipate, 192 parts of dimethyl terephthalate, 216 parts of ethylene oxide adduct of bisphenol A, 38 parts of ethylene glycol, and 0.037 parts of tetrabutoxy titanate as a catalyst. After introducing nitrogen gas as an inactive atmosphere to the flask, these materials are heated to 150 to 230° C. for about 12 hours to be subjected to polycondensation, followed by gradual reduction of pressure at 210 to 250° C. Thus, an amorphous polyester resin is prepared.

Next, 115 parts of the amorphous polyester resin, 180 parts of deionized water, and 5 parts of an anionic surfactant (NEOGEN R from Dai-ichi Kogyo Seiyaku Co., Ltd.) are mixed and heated to 120° C. The mixture is then subjected to a dispersion treatment by a homogenizer (ULTRA-TURRAX T50 from IKA) and another dispersion treatment by a pressure discharge gaulin homogenizer for 1 hour. Thus, an amorphous polyester resin dispersion containing 40% by weight of the resin particles is prepared.

Preparation of Toner

First, 105 parts of the crystalline polyester resin dispersion 1, 336 parts of the amorphous polyester resin dispersion, 45 parts of a black colorant dispersion, 115 parts of a release agent dispersion, and 402 parts of deionized water are mixed in a stainless-steel round flask and dispersed by a homogenizer (ULTRA-TURRAX T50 from IKA).

Further, 0.37 parts of polyaluminum chloride are added to the flask and the resulting mixture is dispersed by the homogenizer (ULTRA-TURRAX T50 from IKA). The flask is heated to 52° C. in an oil bath while agitating the mixture. After keeping the flask at 52° C. for 3 hours, 175 parts of the amorphous polyester resin dispersion are further added thereto.

The mixture is controlled to have a pH of 8.5 by addition of a 0.5N aqueous solution of sodium hydroxide. The flask is sealed and heated to 90° C. for 3 hours while agitating the mixture by magnetic force.

After termination of the reaction, the mixture is subjected to cooling, filtration, washing with ion-exchange water, and solid-liquid separation by nutsche suction filtration. The solid components are washed by being redispersed in 3 liters of ion-exchange water at 40° C. and agitated for 15 minutes at 300 rpm.

This operation is repeated 5 times. When the filtrate became to have a pH of 7.00, an electric conductivity of 8.7 μS/cm, and a surface tension of 7.08 Nm, solid-liquid separation is performed by nutsche suction filtration using a filter paper No. 5A, followed by 12 hours of vacuum drying. Thus, a mother toner particle A is prepared.

The mother toner particle A in an amount of 100 parts is mixed with 1.5 parts of a hydrophobized silica (TS720 from Cabot Corporation) by a HENSCHEL MIXER for 5 minutes at 3,000 rpm. Thus, a toner 1 is prepared.

Toner Examples 2 to 13

The procedure in Toner Example 1 is repeated except that the crystalline resin dispersion 1 is replaced with other crystalline resin dispersions as shown in Table 3. Thus, toners 2 to 13 are prepared. The toners 12 and 13 are comparative examples.

TABLE 3

| Toner No. | Crystalline Polyester Resin Dispersion No. | Volume Average Particle Diameter Dv (μm) | Number Average Particle Diameter Dn (μm) | Dv/Dn |
|---|---|---|---|---|
| 1 | 1 | 4.95 | 4.38 | 1.13 |
| 2 | 2 | 5.03 | 4.37 | 1.15 |
| 3 | 3 | 5.05 | 4.39 | 1.15 |
| 4 | 4 | 4.87 | 4.20 | 1.16 |
| 5 | 5 | 4.90 | 4.26 | 1.15 |
| 6 | 6 | 4.75 | 4.17 | 1.14 |
| 7 | 7 | 5.12 | 4.49 | 1.14 |
| 8 | 8 | 4.77 | 4.22 | 1.13 |
| 9 | 9 | 4.65 | 4.08 | 1.14 |
| 10 | 10 | 4.98 | 4.33 | 1.15 |
| 11 | 11 | 5.02 | 4.33 | 1.16 |
| 12 (Comparative) | 12 (Comparative) | 5.11 | 4.52 | 1.13 |
| 13 (Comparative) | 13 (Comparative) | 4.95 | 4.38 | 1.13 |

Developer Examples 1 to 13

Each of the toners 1 to 13 in an amount of 5% by weight and a copper-zinc ferrite carrier having an average particle diameter of 40 μm in an amount of 95% by weight are uniformly mixed by a TURBULA MIXER. Thus, developers 1 to 13 are prepared.

Preparation of Wax Dispersions

Preparation of Low-Molecular-Weight Polyester

A reaction vessel equipped with a condenser, a stirrer, and a nitrogen inlet pipe is charged with 229 parts of ethylene oxide 2 mol adduct of bisphenol A, 529 parts of propylene oxide 3 mol adduct of bisphenol A, 208 parts of terephthalic acid, 46 parts of adipic acid, and 2 parts of dibutyltin oxide. The mixture is subjected to reaction for 8 hours at 230° C. under normal pressure, and subsequent 5 hours at reduced pressures of 10 to 15 mmHg. After adding 44 parts of trimellitic anhydride, the mixture is further subjected to reaction for 2 hours at 180° C. under normal pressures. Thus, a low-molecular-weight polyester 1 is prepared. The low-molecular-weight polyester 1 has a number average molecular weight of 2,500, a weight average molecular weight of 6,700, a glass transition temperature (Tg) of 43° C., and an acid value of 25 mgKOH/g.

Wax Dispersion Example 1

A carnauba wax having a melting point of 85° C. is contained in the high pressure cell 14 in the particle producing apparatus 1 illustrated in FIG. 4 and FIG. 5, and mixed with carbon dioxide having a temperature of 80° C. and a pressure of 10 MPa as a supercritical fluid over a period of 1 hour. The resulting melt has a viscosity of 1 mPa·s, which is out of the detective range. The viscosity of the melt is measured by a viscometer VISCOlab PVT (from Cambridge Viscosity, Inc.). The viscometer controls temperature and pressure of the sample to determine the viscosity at which the temperature and pressure become constant.

The carbon dioxide is then introduced into the space defined by the particle forming member 331 in the discharger 31 by opening the valve 23 while keeping its temperature of 80° C. and pressure of 10 MPa by the actions of the pump 22 and a heater. At the same time, the melt of the carnauba wax is introduced into the storage 311 in the discharger 31 by opening the valve 13*b* and putting the pump 12*b* into operation. Further, a sine wave having an alternating current frequency of 320 KHz is transmitted from the signal generator 320 to the vibrator 312 comprised of a layered PZT to excite the discharger 31, resulting in formation of particles of the melt. After returning to the atmospheric pressure, the particles of the melt are discharged into ethyl acetate in which 20% by weight of the low-molecular-weight polyester is dissolved. Thus, a wax dispersion 1 is prepared. It is confirmed by a micro stroboscopic method that the discharged melt is first formed into a columnar melt and the columnar melt is constricted and separated into particles. The through holes 317 in a number of 100 are disposed in a houndstooth pattern on SUS (stainless steel) having a thickness of 50 μm. Each of the through holes 317 has a diameter of 8.0 μm. The high pressure cell 14 is controlled to have a constant temperature of 80° C. and a constant pressure of 10 MPa by the actions of the pump 12*a* and the back pressure valve 15. The pressure difference between in the storage 311 and in the upper part of the particle forming member 331 is adjusted to 80±50 KPa by the action of the open valve 322.

The wax particles in the resulting wax dispersion have a volume average particle diameter (Dv) of 0.33 μm, a number average particle diameter (Dn) of 0.32 μm, and a ratio Dv/Dn of 1.03. The volume average particle diameter (Dv) and the number average particle diameter (Dn) are measured using a particle size analyzer COULTER COUNTER TA II (from Beckman Coulter).

Shape change of the melt is observed by a micro stroboscopic method. Specifically, a pressure-resistant circular quartz glass having a diameter of 1 cm is provided to a side surface of the support 319 in the discharger 31 to observe shape change of the melt after being discharged from the through holes 317. An LED (Light Emitting Diode) light emitting light to the vicinity of the through holes 317 is also provided. The emission angle is 30 degrees relative to the quartz glass. The LED light flashes in synchronization with transmission of vibration from the signal generator 320 to the melt. Further, a highly-sensitive CCD camera photographing shape change of the melt is provided in front of the quartz glass. When shape change is synchronized with flashing of the LED light, a clear photograph is obtained. However, when shape change is not synchronized with flashing of the LED light, a blurred photograph is obtained. When the melt is formed into a column and the column is periodically constricted into particles due to a constant vibration, shape change as illustrated in FIG. 6 is photographed. When the melt is formed into a random shape, the melt in neither columnar nor particulate form is not observed.

Wax Dispersion Examples 2 to 4

The procedure in Wax Dispersion Example 1 is repeated except that the carnauba wax is replaced with a paraffin wax having a melting point of 75° C. and the temperature and pressure conditions in the high-pressure cell 14 are changed as shown in Table 4. Thus, wax dispersions 2 to 4 are prepared. It is confirmed by the micro stroboscopic method that the discharged melt is first formed into a columnar melt and the columnar melt is constricted and separated into particles. The volume average particle diameter (Dv) and the number average particle diameter (Dn) of the wax dispersions 2 to 4 are shown in Table 4.

Wax Dispersion Comparative Example 1

The procedure in Wax Dispersion Example 1 is repeated except that no compressible fluid (carbon dioxide) is introduced into the space defined by the particle forming member 331 in the discharger 31 by closing the valve 23. As a result, the SUS film having the through holes 317 gets broken and a wax dispersion is not produced.

Wax Dispersion Comparative Example 2

The procedure in Wax Dispersion Example 2 is repeated except that no compressible fluid (carbon dioxide) is introduced into the space defined by the particle forming member 331 in the discharger 31 by closing the valve 23. As a result, the SUS film having the through holes 317 gets broken and a wax dispersion is not produced.

The temperature and pressure conditions in the high-pressure cell in the above Wax Dispersion Examples 1 to 4 and Comparative Examples 1 and 2 are shown in the following Table 4.

TABLE 4

| Wax Dispersion No. | Wax Species | Temperature in High-Pressure Cell (° C.) | Pressure in High-Pressure Cell (MPa) | Volume Average Particle Diameter Dv (μm) | Number Average Particle Diameter Dn (μm) | Dv/Dn |
|---|---|---|---|---|---|---|
| 1 | Carnauba | 80 | 10 | 0.33 | 0.32 | 1.03 |
| 2 | Paraffin | 80 | 10 | 0.29 | 0.28 | 1.02 |
| 3 | Paraffin | 60 | 15 | 0.41 | 0.39 | 1.05 |
| 4 | Paraffin | 40 | 40 | 0.36 | 0.35 | 1.03 |
| Comparative 1 | Carnauba | 80 | 10 | — | — | — |
| Comparative 2 | Paraffin | 80 | 10 | — | — | — |

Preparation of Toners and Developers

Toner Example 14

Preparation of Resin Particle Dispersion

A reaction vessel equipped with a stirrer and a thermometer is charged with 683 parts of water, 11 parts of a sodium salt of a sulfate of ethylene oxide adduct of methacrylic acid (ELEMINOL RS-30 from Sanyo Chemical Industries, Ltd.), 83 parts of styrene, 83 parts of methacrylic acid, 110 parts of butyl acrylate, and 1 part of ammonium persulfate. The mixture is agitated for 15 minutes at a revolution of 400 rpm, thus preparing a white emulsion. The white emulsion is heated to 75° C. and subjected to reaction for 5 hours. A 1% aqueous solution of ammonium persulfate in an amount of 30 parts is further added to the emulsion, and the mixture is aged for 5 hours at 75° C. Thus, a resin particle dispersion 1 that is an aqueous dispersion of a vinyl resin (i.e., a copolymer of styrene, methacrylic acid, butyl acrylate, and a sodium salt of a sulfate of ethylene oxide adduct of methacrylic acid) is prepared. The resin particle dispersion 1 has a volume average particle diameter of 0.14 μm when measured by a laser diffraction particle size distribution analyzer LA-920 (from Horiba, Ltd.). The dried resin particles separated from the resin particle dispersion 1 have a glass transition temperature (Tg) of 152° C.

Preparation of Aqueous Phase

An aqueous phase 1 is prepared by mixing 990 parts of water, 83 parts of the resin particle dispersion 1, 37 parts of a 48.5% aqueous solution of dodecyl diphenyl ether sodium disulfonate (ELEMINOL MON-7 from Sanyo Chemical Industries, Ltd.), and 90 parts of ethyl acetate. The aqueous phase 1 is a milky whitish liquid.

Preparation of Intermediate Polyester

A reaction vessel equipped with a condenser, a stirrer, and a nitrogen inlet pipe is charged with 682 parts of ethylene oxide 2 mol adduct of bisphenol A, 81 parts of propylene oxide 2 mol adduct of bisphenol A, 283 parts of terephthalic acid, 22 parts of trimellitic anhydride, and 2 parts of dibutyltin oxide. The mixture is subjected to reaction for 8 hours at 230° C. under normal pressures and subsequent 5 hours under reduced pressures of 10 to 15 mmHg. Thus, an intermediate polyester 1 is prepared. The intermediate polyester 1 has a number average molecular weight of 2,100, a weight average molecular weight of 9,500, a glass transition temperature (Tg) of 55° C., and an acid value of 0.5 mgKOH/g, and a hydroxyl value of 51 mgKOH/g. Another reaction vessel equipped with a condenser, a stirrer, and a nitrogen inlet pipe is charged with 410 parts of the intermediate polyester 1, 89 parts of isophorone diisocyanate, and 500 parts of ethyl acetate. The mixture is subjected to reaction for 5 hours at 100° C. Thus, a prepolymer 1 is prepared. The prepolymer 1 is including 1.53% of free isocyanates.

Preparation of Ketimine

A reaction vessel equipped with a stirrer and a thermometer is charged with 170 parts of isophoronediamine and 75 parts of methyl ethyl ketone. The mixture is subjected to reaction for 5 hours at 50° C. Thus, a ketimine compound I is prepared. The ketimine compound I has an amine value of 418 mgKOH/g.

Preparation of Master Batch

First, 1,200 parts of water, 540 parts of a carbon black having a DBP oil absorption of 42 ml/100 g and a pH of 9.5 (PRINTEX 35 from Degussa), and 1,200 parts of the low-molecular-weight polyester 1 are mixed using a HENSCHEL MIXER (from Mitsui Mining and Smelting Co., Ltd.). The resulting mixture is kneaded for 30 minutes at 150° C. using a double roll, the kneaded mixture is then rolled and cooled, and the rolled mixture is then pulverized into particles using a pulverizer. Thus, a master batch 1 is prepared.

Preparation of Oil Phase

A reaction vessel equipped with a stirrer and a thermometer is charged with 278 parts of the low-molecular-weight polyester 1, 22 parts of a charge controlling agent (a salicylic acid metal complex E-84 from Orient Chemical Industries Co., Ltd.), and 647 parts of ethyl acetate. The mixture is heated to 80° C. while being agitated, kept at 80° C. for 5 hours, and cooled to 30° C. over a period of 1 hour. The mixture is further mixed with 500 parts of the master batch 1, 500 parts of ethyl acetate, and 454 parts of the wax dispersion 1 for 1 hour. Thereafter, 1,324 parts of the resulting mixture is subjected to a dispersion treatment using a bead mill (ULTRAVISCOMILL (trademark) from Aimex Co., Ltd.) filled with 80% by volume of zirconia beads having a diameter of 0.5 mm, at a liquid feeding speed of 1 kg/hour and a disc peripheral speed of 6 msec. This dispersing operation is repeated 3 times (3 passes). Further, 1,042.3 parts of a 65% ethyl acetate solution of the low-molecular-weight polyester 1 are added, and the resulting mixture is subjected to the above dispersing operation for 1 time (1 pass). Thus, a colorant wax dispersion 1 is prepared. The colorant wax dispersion 1 is containing solid components in an amount of 50% by weight.

Emulsification and Solvent Removal

The colorant wax dispersion 1 in an amount of 664 parts, the intermediate polyester 1 in an amount of 109.4 parts, and the ketimine compound 1 in an amount of 4.6 parts are contained in a vessel and mixed by a TK HOMOMIXER (from PRIMIX Corporation) for 1 minute. The aqueous phase 1 in an amount of 1,200 parts is further added to the vessel and mixed by a TK HOMOMIXER at a revolution of 13,000 rpm for 1 minute. Thus, an emulsion slurry 1 is prepared. The emulsion slurry 1 is contained in a vessel equipped with a stirrer and a thermometer, and subjected to solvent removal for 8 hours at 30° C., and subsequent aging for 4 hours at 40° C. Thus, a dispersion slurry 1 is prepared.

Washing and Drying

The dispersion slurry 1 in an amount of 100 parts is filtered under reduced pressures, thus obtaining a wet cake (i). The wet cake (i) is mixed with 100 parts of ion-exchange water using a TK HOMOMIXER for 10 minutes at a revolution of 12,000 rpm, followed by filtering, thus obtaining a wet cake (ii). The wet cake (ii) is mixed with 100 parts of a 10% aqueous solution of sodium hydroxide using a TK HOMOMIXER for 30 minutes at a revolution of 12,000 rpm, followed by filtering under reduced pressures, thus obtaining a wet cake (iii). The wet cake (iii) is mixed with 100 parts of a 10% hydrochloric acid using a TK HOMOMIXER for 10 minutes at a revolution of 12,000 rpm, followed by filtering, thus obtaining a wet cake (iv). The wet cake (iv) is mixed with 300 parts of ion-exchange water using a TK HOMOMIXER for 10 minutes at a revolution of 12,000 rpm, followed by filtering. This operation is repeated twice, thus obtaining a wet cake (v). The wet cake (v) is dried by a circulating drier for 48 hours at 45° C., and filtered with a mesh having openings of 75 μm. Thus, a toner 14 is prepared.

Toner Examples 15 to 17

The procedure in Toner Example 14 is repeated except for replacing the wax dispersion 1 with each of the wax dispersions 2 to 4. Thus, toners 15 to 17 are prepared.

Developer Examples 14 to 17

Each of the toners 14 to 17 in an amount of 100 parts is mixed with 0.7 parts of a hydrophobized silica and 0.3 parts of a hydrophobized titanium oxide by a HENSCHEL MIXER for 5 minutes at a peripheral speed of 8 m/s. The resulting mixture is filtered with a mesh having openings of 100 μm to remove coarse particles. Further, the toner externally treated as above in an amount of 5% by weight is uniformly mixed with 95% by weight of a copper-zinc ferrite carrier having an average particle diameter of 40 μm and a silicone resin covering layer by a TURBULA MIXER. Thus, developers 14 to 17 are prepared.

Each of the above-prepared developers 1 to 17 is set in an image forming apparatus (IPSIO COLOR 8100 from Ricoh Co., Ltd.) and subjected to the following evaluations.

Evaluation of Image Density

A solid image including 0.3±0.1 mg/cm$^2$ of toner is formed on a normal transfer paper (TYPE 6200 from Ricoh Co., Ltd.) and its image density is measured by an instrument X-RITE (from X-Rite). The measured image density is graded as follows.

A+: Image density is not less than 1.4.

A: Image density is not less than 1.35 and less than 1.4.

B: Image density is not less than 1.3 and less than 1.35.

C: Image density is less than 1.3.

Evaluation of Cleanability

An image chart having an image area ratio of 95% is produced on 1,000 sheets of paper. Residual toner particles remaining on the photoreceptor even after the photoreceptor is cleaned are transferred onto white paper with a SCOTCH TAPE (from 3M), and its density is measured by a Macbeth reflective densitometer RD514. Cleanability is evaluated by the difference between the measured density and the blank density, and is graded as follows.

A+: The density difference is less than 0.005.

A: The density difference is 0.005 to 0.010.

B: The density difference is 0.011 to 0.02.

C: The density difference is greater than 0.02.

Evaluation of Charge Stability

A running test in which a text image chart having an image area ratio of 12% is continuously produced on 100,000 sheets of paper is performed. A small amount of the developer is collected from the developing sleeve and charge quantity of the developer is measured by a blow off method before and after the running test. Charge stability is evaluated by amount of change in charge quantity before and after the running test, and is graded as follows.

A: The amount of change is less than 5 μC/g.

B: The amount of change is 5 to 10 μC/g.

C: The amount of change is greater than 10 μC/g.

Evaluation of Filming

Band-like charts having an image area ratio of 100%, 75%, and 50% are produced on 1,000 sheets of paper. Thereafter, the developing roller and the photoreceptor are visually observed to determine whether or not a thin film of toner is formed thereon (this phenomenon is hereinafter "filming").

A+: Filming does not occur.

A: Slight filming occurs.

B: Linear filming occurs.

C: Filming occurs in the whole surface.

Evaluation of Fixability

An electrophotographic copier (MF-200 from Ricoh Co., Ltd.) employing a TEFLON fixing roller is modified so that the temperature of the fixing roller is variable. Each of the toners is mounted on the copier, and solid images having 0.85±0.1 mg/cm$^2$ of the toner are formed on sheets of a normal paper TYPE 6200 (from Ricoh Co., Ltd.) and a thick paper <135> (from NBS Ricoh) while varying the temperature of the fixing roller to determine the maximum and minimum fixable temperatures. The maximum fixable temperature is a temperature above which hot offset occurs on the normal paper. The minimum fixable temperature is a temperature below which the residual rate of image density after rubbing the solid image falls below 70% on the thick paper. The grades A, B, and C can be put into practical use and the grade D cannot.

Maximum Fixable Temperature Grades

A+: The maximum fixable temperature is not less than 190° C.

A: The maximum fixable temperature is not less than 180° C. and less than 190° C.

B: The maximum fixable temperature is not less than 170° C. and less than 180° C.

C: The maximum fixable temperature is less than 170° C.

Minimum Fixable Temperature Grades

A+: The minimum fixable temperature is less than 135° C.

A: The minimum fixable temperature is not less than 135° C. and less than 145° C.

B: The minimum fixable temperature is not less than 145° C. and less than 155° C.

C: The minimum fixable temperature is not less than 155° C.

The evaluation results are shown in Tables 5-1 and 5-2.

TABLE 5-1

| Toner & Developer No. | Image Density | Cleanability | Charge Stability | Filming | Minimum Fixable Temperature | Maximum Fixable Temperature |
|---|---|---|---|---|---|---|
| 1 | A+ | A+ | A | B | A+ | A+ |
| 2 | B | A | A | A+ | A | A+ |
| 3 | A+ | A+ | A | A | A+ | A+ |
| 4 | A | A+ | A | A+ | A+ | A+ |
| 5 | A+ | B | A | A+ | A+ | A+ |
| 6 | A | A+ | A | A+ | A | A |
| 7 | A+ | A+ | A | A+ | A+ | A+ |
| 8 | B | A+ | A | A+ | A+ | A+ |
| 9 | A+ | A | A | A+ | A+ | A+ |
| 10 | A+ | A+ | A | A+ | B | A+ |
| 11 | A+ | A | A | A+ | A+ | A+ |
| 12 (Comparative) | B | B | C | C | B | C |
| 13 (Comparative) | C | C | C | B | C | C |

TABLE 5-2

| Toner & Developer No. | Image Density | Cleanability | Charge Stability | Filming | Minimum Fixable Temperature | Maximum Fixable Temperature |
|---|---|---|---|---|---|---|
| 1 | A+ | A+ | A | A+ | A | A+ |
| 2 | A+ | A+ | A | A+ | A+ | A+ |
| 3 | A+ | A+ | A | A+ | A+ | A+ |
| 4 | A+ | A+ | A | A+ | A+ | A+ |

What is claimed is:

1. A particle producing method, comprising:

bringing a material into contact with a compressible fluid to prepare a melt of the material; and discharging the melt from a vibrated through hole to form particles of the melt.

2. The particle producing method according to claim 1, wherein the material being a crystalline polyester resin or a release agent.

3. The particle producing method according to claim 2, wherein the release agent being a wax.

4. The particle producing method according to claim 1, wherein the melt being discharged from the vibrated through hole due to a pressure difference, and the particles being formed such that the discharged melt is formed into a columnar melt and the columnar melt is constricted and separated into particles.

5. The particle producing method according to claim 1, wherein the compressible fluid comprising a supercritical carbon dioxide or a liquefied carbon dioxide.

* * * * *